US009925784B2

(12) United States Patent
Takahashi et al.

(10) Patent No.: US 9,925,784 B2
(45) Date of Patent: Mar. 27, 2018

(54) LIQUID CARTRIDGE PROVIDED WITH DEFORMABLE MEMBER, MOVABLE MEMBER, AND URGING MEMBER FOR DETECTION OF REMAINING AMOUNT OF LIQUID

(71) Applicant: BROTHER KOGYO KABUSHIKI KAISHA, Nagoya-shi, Aichi-ken (JP)

(72) Inventors: Hiroaki Takahashi, Nagoya (JP); Suguru Tomoguchi, Okazaki (JP); Tetsuro Kobayashi, Nagoya (JP); Naoya Okazaki, Gifu-ken (JP); Akihito Ono, Nagoya (JP); Yuki Takagi, Nagoya (JP); Kosuke Nukui, Nagoya (JP); Mikio Hirano, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/276,927

(22) Filed: Sep. 27, 2016

(65) Prior Publication Data

US 2017/0282580 A1 Oct. 5, 2017

(30) Foreign Application Priority Data

Mar. 31, 2016 (JP) ..... 2016-072386

(51) Int. Cl.
*B41J 2/175* (2006.01)

(52) U.S. Cl.
CPC ..... *B41J 2/17543* (2013.01)

(58) Field of Classification Search
CPC ..... B41J 2/17543; B41J 2/17546; B41J 2/17566; B41J 2/17573; B41J 2002/17573; B41J 2002/17586
See application file for complete search history.

(56) References Cited

U.S. PATENT DOCUMENTS 5,136,309 A 8/1992 Iida et al.
5,736,992 A 4/1998 Pawlowski, Jr.
(Continued)

FOREIGN PATENT DOCUMENTS

CN 201645998 U 11/2010
EP 2 371 555 A2 10/2011
(Continued)

OTHER PUBLICATIONS

"Extended European Search Report issued in related EP application No. 16190843.9, dated Jul. 27, 2017."
(Continued)

*Primary Examiner* — Geoffrey Mruk
*Assistant Examiner* — Scott A Richmond
(74) *Attorney, Agent, or Firm* — Merchant & Gould P.C.

(57) ABSTRACT

A liquid cartridge includes: a casing including a liquid chamber; a liquid supply portion; a deformable member; a movable member; and an urging member. An internal pressure of the chamber is reduced as liquid flows out of the chamber. The deformable member protrudes from the casing in a cross direction crossing forward and rearward directions and has an internal space in communication with the chamber. The deformable member has such an elasticity that a dimension thereof in the cross direction becomes smaller as the internal pressure of the chamber is reduced. The movable member includes a detection portion, and a contact portion contacting the deformable member. The contact portion is in contact with the deformable member and disposed at one of positions further forward and further rearward relative to the deformable member. The urging member urges the movable member to move the contact portion toward the deformable member.

15 Claims, 12 Drawing Sheets

(56) References Cited

U.S. PATENT DOCUMENTS

| | | | | |
|---|---|---|---|---|
| 7,424,824 | B2 | 9/2008 | Usui | |
| 8,317,306 | B2 | 11/2012 | Hattori | |
| 2009/0289972 | A1 | 11/2009 | Iino | |
| 2011/0249064 | A1 | 10/2011 | Wang et al. | |
| 2011/0292138 | A1* | 12/2011 | Ma | B41J 2/17566 347/86 |
| 2013/0033552 | A1* | 2/2013 | Chen | B41J 2/17513 347/86 |
| 2013/0141499 | A1 | 6/2013 | Tomoguchi et al. | |
| 2014/0098145 | A1* | 4/2014 | Kanbe | B41J 2/17503 347/6 |
| 2014/0300671 | A1 | 10/2014 | Nie | |
| 2016/0039215 | A1 | 2/2016 | Sugahara et al. | |
| 2017/0282585 | A1 | 10/2017 | Kobayashi | |

FOREIGN PATENT DOCUMENTS

| | | | |
|---|---|---|---|
| EP | 2 524 810 | A1 | 11/2012 |
| JP | 3156861 | U | 1/2010 |
| JP | 3157392 | U | 2/2010 |
| WO | 2011050759 | A1 | 5/2011 |

OTHER PUBLICATIONS

Extended European Search Report issued in related EP application No. 16190815.7, dated Augsut 22, 2017.

Extended European Search Report issued in related EP application No. 16190817.3, dated Sep. 13, 2017.

Office Action issued in related U.S. Appl. No. 15/277,074, dated Oct. 6, 2017.

Application as filed in related U.S. Appl. No. 15/277,030, dated Sep. 27, 2016.

Application as filed in related U.S. Appl. No. 15/277,074, dated Sep. 27, 2016.

Application as filed in related U.S. Appl. No. 15/276,958, dated Sep. 27, 2016.

Office Action issued in related U.S. Appl. No. 15/276,958, dated Oct. 20, 2017.

Office Action issued in related U.S. Appl. No. 15/277,030, dated Nov. 3, 2017.

Extended European Search Report issued in related European Application No. 16190768.8, dated Nov. 27, 2017.

* cited by examiner

LIQUID CARTRIDGE PROVIDED WITH DEFORMABLE MEMBER, MOVABLE MEMBER, AND URGING MEMBER FOR DETECTION OF REMAINING AMOUNT OF LIQUID

CROSS REFERENCE TO RELATED APPLICATION

This application claims priority from Japanese Patent Application No. 2016-072386 filed Mar. 31, 2016. The entire content of the priority application is incorporated herein by reference.

TECHNICAL FIELD

The present disclosure relates to a liquid cartridge provided with a movable member that moves in accordance with elastic deformation of a deformable member.

BACKGROUND

There are conventional inkjet recording apparatus known in the art that can record an image on a recording medium by ejecting ink stored in an ink container through nozzles. One such inkjet recording apparatus is configured such that a new ink cartridge can be attached every time ink in an ink cartridge that has been attached is consumed.

Japanese Utility Model Registration Publication No. 3156861 discloses an ink cartridge that can be attached to and detached from a cartridge attachment section of an inkjet recording apparatus. The ink cartridge has a detection mechanism that is used for optical detection of a remaining amount of ink. The detection mechanism includes a movable member that can pivotally move about a fixed shaft, and a deformable member. When ink stored in an ink bag is consumed, the ink bag deflates. As the ink bag deflates, the deformable member also deflates. This causes the movable member to change its pivoting posture. By optically detecting the change in the pivoting posture of the movable member, consumption of ink in the ink cartridge can be detected.

SUMMARY

In the ink cartridge described above, the movable member hangs down due to a gravitational force acting thereon, thereby contacting the deformable member. When the deformable member deflates, the movable member pivotally moves further downward due to the gravitational force. However, this structure requires the detection mechanism to be provided at a position where the gravitational force can be applied, such as at a front surface of the ink cartridge.

In view of the foregoing, it is an object of the disclosure to provide a liquid cartridge having an enhanced degree of freedom in layout of a detection mechanism.

In order to attain the above and other objects, the disclosure provides a liquid cartridge including: a casing; a liquid supply portion; a deformable member; a movable member; and an urging member. The casing includes a front wall and a liquid chamber configured to store liquid therein. The liquid chamber is configured such that an internal pressure of the liquid chamber is reduced in accordance with outflow of liquid from the liquid chamber. The liquid supply portion is disposed at the front wall and configured to allow liquid in the liquid chamber to flow out of the liquid chamber. The deformable member protrudes from the casing in a cross direction that crosses a forward direction and a rearward direction and has an internal space that is in communication with the liquid chamber. The deformable member has such an elasticity that a dimension of the deformable member in the cross direction becomes smaller in accordance with the reduction in the internal pressure of the liquid chamber. The movable member includes a detection portion configured to be detected from an exterior of the liquid cartridge and a contact portion configured to contact the deformable member. The movable member is supported to the casing and movable in the forward direction and the rearward direction relative to the casing. The contact portion is in contact with the deformable member and disposed at one of a position further forward relative to the deformable member and a position further rearward relative to the deformable member. The urging member is configured to urge the movable member to move the contact portion toward the deformable member.

BRIEF DESCRIPTION OF THE DRAWINGS

The particular features and advantages of the embodiment(s) as well as other objects will become apparent from the following description taken in connection with the accompanying drawings, in which:

FIGS. 11A through 11D are schematic vertical cross-sectional views of an ink cartridge 330 according to a second modification to the embodiment, in which FIG. 11A illustrates a state where an opening 358 is opened; and FIG. 11B illustrates a state where the opening 358 is closed; FIG. 11C illustrates a state where an ink channel 344 is under a negative pressure; and FIG. 11D illustrates a state where an opening 355 is opened;

DETAILED DESCRIPTION

Figure 1:
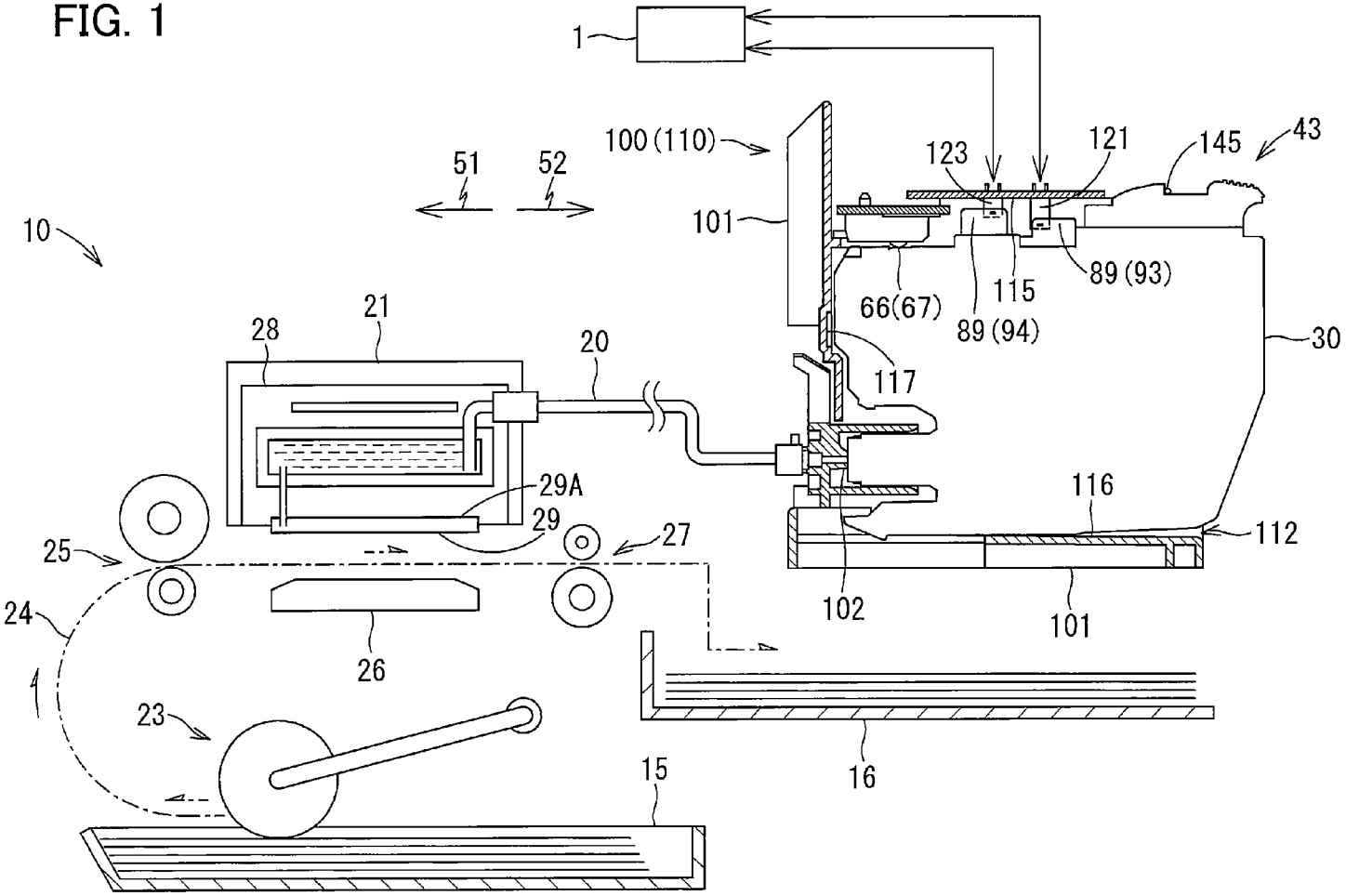
FIG. 1 is a schematic cross-sectional diagram illustrating an internal structure of a printer 10 provided with a cartridge attachment section 110 to which an ink cartridge 30 according to one embodiment is detachably attached.

An ink cartridge 30 as an example of a liquid cartridge according to one embodiment and a printer 10 configured to accommodate the ink cartridge 30 will be described with reference to FIGS. 1 through 9, wherein like parts and components are designated by the same reference numerals to avoid duplicating description.

In the following description, a direction in which the ink cartridge 30 is inserted into a cartridge attachment section 110 is defined as a forward direction 51, and a direction opposite to the forward direction 51, that is, a direction in which the ink cartridge 30 is removed from the cartridge attachment section 110 is defined as a rearward direction 52. The forward direction 51 and the rearward direction 52 are parallel to a horizontal direction in the embodiment, but the forward direction 51 and the rearward direction 52 may not necessarily be parallel to the horizontal direction.

Further, a direction orthogonal to the forward direction 51 and the rearward direction 52 is defined as an upward direction 54, and a direction opposite the upward direction 54 is defined as a downward direction 53. In the embodiment, the upward direction 54 is a vertically upward direction, while the downward direction 53 is a vertically downward direction. In other words, the downward direction 53 is a direction of a gravitational force acting on the ink cartridge 30. Note that the upward direction 54 and the downward direction 53 may not necessarily be parallel to a vertical direction.

Further, directions orthogonal to the forward direction 51 and the downward direction 53 are defined as a rightward direction 55 and a leftward direction 56. More specifically, when the ink cartridge 30 has been inserted into the cartridge attachment section 110, i.e., when the ink cartridge 30 is in a posture attachable to the cartridge attachment section 110 (i.e. an operational posture), a direction toward the right is defined as the rightward direction 55 and a direction toward the left is defined as the leftward direction 56 when the ink cartridge 30 is viewed in the forward direction 51, i.e., when the ink cartridge 30 is viewed from the rear to the front. In the embodiment, the rightward direction 55 and the leftward direction 56 are parallel to the horizontal direction, but the rightward direction 55 and the leftward direction 56 may not necessarily be parallel to the horizontal direction.

<Overview of Printer 10>

The printer 10 is configured to selectively eject ink droplets onto recording sheets to record images thereon based on an inkjet recording method. As illustrated in FIG. 1, the printer 10 includes a recording head 21, an ink supply device 100, and ink tubes 20 connecting the recording head 21 to the ink supply device 100. The ink supply device 100 includes the cartridge attachment section 110. A plurality of ink cartridges 30 is attachable to and detachable from the cartridge attachment section 110. The cartridge attachment section 110 has one end in which an opening 112 is formed. The ink cartridges 30 can be inserted into the cartridge attachment section 110 through the opening 112 in the forward direction 51, and can be removed from the cartridge attachment section 110 through the opening 112 in the rearward direction 52.

In the embodiment, four ink cartridges 30 corresponding to respective four colors of cyan, magenta, yellow, and black can be accommodated in the cartridge attachment section 110 of the ink supply device 100. For an explanatory purpose, in the following description and in the drawings, only one ink cartridge 30 is assumed to be attached to the cartridge attachment section 110 unless otherwise specified.

The ink cartridge 30 stores ink (an example of liquid) that can be used in the printer 10. When the ink cartridge 30 has been completely attached to the cartridge attachment section 110, the ink cartridge 30 and the recording head 21 are connected by corresponding one of the ink tubes 20. The recording head 21 is provided with a plurality of (four in the embodiment) sub-tanks 28 corresponding to the plurality of ink cartridges 30. Each sub-tank 28 is configured to temporarily store the ink supplied from the corresponding ink cartridge 30 through the corresponding ink tube 20. The recording head 21 is configured to selectively eject the ink supplied from the respective sub-tanks 28 through nozzles 29 according to an inkjet recording method. More specifically, the recording head 21 is provided with a head control board, and piezoelectric elements 29A corresponding one-on-one to the nozzles 29. The head control board selectively applies drive voltages to the piezoelectric elements 29A to eject ink selectively from the nozzles 29.

The printer 10 includes a sheet feeding tray 15, a sheet feeding roller 23, a pair of conveying rollers 25, a platen 26, a pair of discharge rollers 27, and a sheet discharge tray 16. The sheet feeding roller 23 feeds recording sheets from the sheet feeding tray 15 onto a conveying path 24, and the conveying rollers 25 convey the recording sheets over the platen 26. The recording head 21 selectively ejects ink onto the recording sheets as the recording sheets pass over the platen 26, whereby images are recorded on the recording sheets and ink stored in the ink cartridge 30 completely attached to the cartridge attachment section 110 is consumed. The discharge rollers 27 receive the recording sheets that have passed over the platen 26 and discharge the recoding sheets onto the sheet discharge tray 16 provided at a position most downstream in the conveying path 24.

<Ink Supply Device 100>

As illustrated in FIG. 1, the ink supply device 100 is provided in the printer 10. The ink supply device 100 is configured to supply ink to the recording head 21 provided in the printer 10. The ink supply device 100 includes the cartridge attachment section 110 to which the ink cartridges 30 can be detachably attached. Incidentally, FIG. 1 illustrates a state of the ink cartridge 30 that has been completely attached to the cartridge attachment section 110.

<Cartridge Attachment Section 110>

Figure 2:
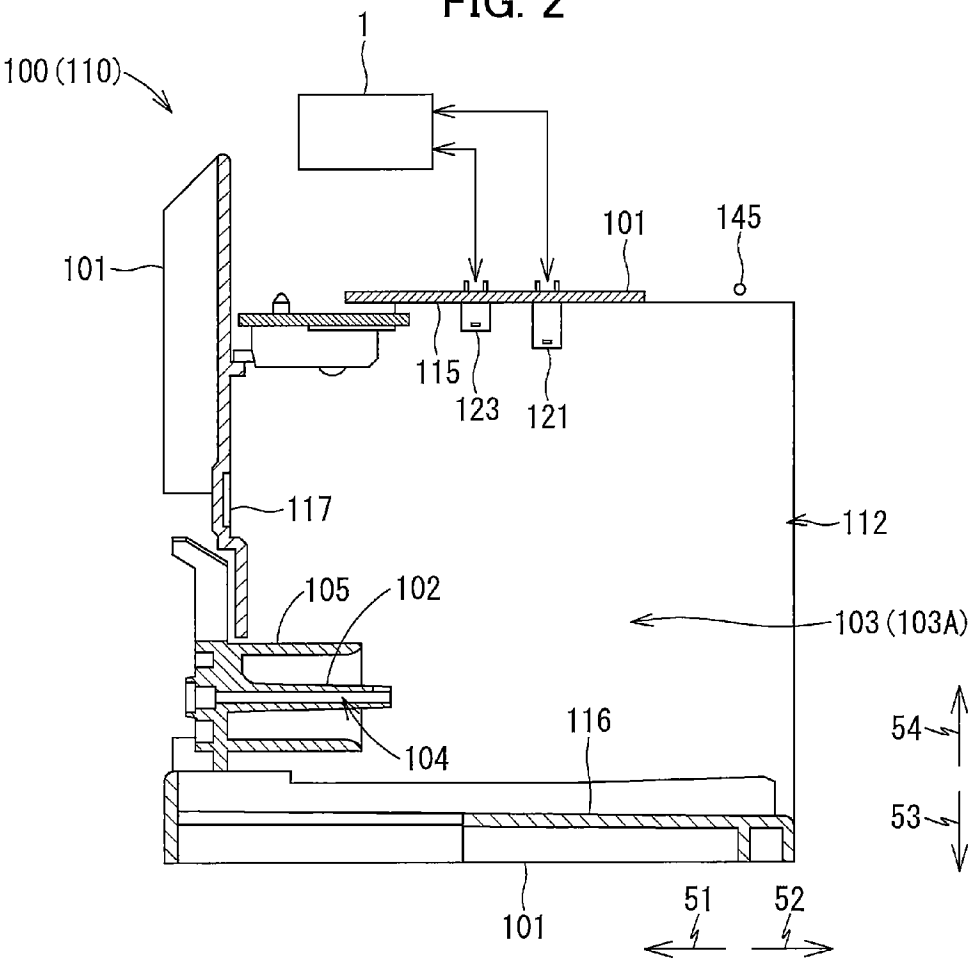
FIG. 2 is a schematic vertical cross-sectional view of the cartridge attachment section 110.

As illustrated in FIG. 2, the cartridge attachment section 110 includes a case 101, a plurality of ink needles 102, a plurality of optical sensors 121, a plurality of optical sensors 123, and a plurality of locking rods 145.

The case 101 is partitioned into four spaces arranged in the rightward direction 55 and the leftward direction 56. In the four spaces, the four ink cartridges 30 corresponding to the four ink colors cyan, magenta, yellow, and black can be accommodated, respectively.

In the embodiment, four ink needles 102, four optical sensors 121, four optical sensors 123, and four locking rods 145 are provided in the cartridge attachment section 110 so as to correspond with the four ink cartridges 30.

The four ink needles 102 are arranged in the rightward direction 55 and the leftward direction 56, and have the same configuration. The four optical sensors 121 are arranged in the rightward direction 55 and the leftward direction 56, and have the same configuration. The four optical sensors 123 are arranged in the rightward direction 55 and the leftward direction 56, and have the same configuration. The four locking rods 145 are arranged in the rightward direction 55 and the leftward direction 56, and have the same configuration.

Hence, in the following description, for the sake of simplicity of explanation, configurations of respective one of the four ink needles 102, the four optical sensors 121, the four optical sensors 123, and the four locking rods 145 will be described in detail, while configurations of respective remaining three of the four ink needles 102, the four optical sensors 121, the four optical sensors 123, and the four locking rods 145 will be omitted.

<Case 101>

As illustrated in FIG. 2, the case 101 constitutes a housing of the cartridge attachment section 110, and is formed in a box shape. The case 101 has an inner top surface 115, an inner bottom surface 116, an inner end surface 117, and the opening 112.

The inner top surface 115 defines a top portion of an internal space 103 of the case 101. The inner bottom surface 116 defines a bottom portion of the internal space 103 of the case 101. The inner end surface 117 defines an end portion of the internal space 103 of the case 101 in the forward direction 51. The inner end surface 117 connects the inner top surface 115 to the inner bottom surface 116. The opening 112 is positioned rearward of the inner end surface 117 and arranged to face the inner end surface 117 in the rearward direction 52. The opening 112 can be exposed to a user interface surface of the printer 10, that is, a surface that a user can face when using the printer 10.

Each of the four ink cartridges 30 is inserted into and removed from the case 101 through the opening 112. The case 101 is provided with three partitioning plates (not illustrated) that partition the internal space 103 into four spaces 103A each elongated in the downward direction 53 and the upward direction 54. The four ink cartridges 30 can be detachably accommodated in the four spaces 103A partitioned by the three partitioning plates, respectively.

The opening 112 formed in the case 101 can be opened and closed by a cover (not illustrated). The cover is attached to a pivot shaft (not illustrated) that extends in the rightward direction 55 and the leftward direction 56 near a lower edge of the opening 112. With this configuration, the cover can be pivotally moved about the pivot shaft to a closed position where the opening 112 is closed and an open position where the opening 112 is opened. When the cover is at the open position, the user can insert the ink cartridge 30 into the case 101 and remove the ink cartridge 30 from the case 101 through the opening 112. When the cover is at the closed position, the user cannot insert the ink cartridge 30 into the case 101 or remove the ink cartridge 30 from the case 101, nor can the user access the ink cartridge 30 accommodated in the case 101.

A cover sensor 118 (see FIG. 7) is provided at the case 101 near an upper edge of the opening 112. The cover sensor 118 is a sensor used for detection as to whether the cover is in contact with the cover sensor 118. When the cover is at the closed position, an upper end portion of the cover is in contact with the cover sensor 118, and the cover sensor 118 outputs a detection signal to the controller 1. When the cover is not at the closed position, the cover is separated from the cover sensor 118, and the cover sensor 118 does not output a detection signal.

<Ink Needle 102>

As illustrated in FIG. 2, the ink needle 102 is made of a resin having a tubular configuration. The ink needle 102 is provided at a lower portion of the inner end surface 117 of the case 101. The ink needle 102 is disposed on the inner end surface 117 of the case 101 at a position corresponding to an ink supply portion 34 (see FIG. 3, describe later) of the ink cartridge 30 attached to the cartridge attachment section 110. The ink needle 102 protrudes in the rearward direction 52 from the inner end surface 117 of the case 101.

A cylindrical-shaped guide portion 105 is provided to surround the ink needle 102. The guide portion 105 protrudes in the rearward direction 52 from the inner end surface 117 of the case 101. The guide portion 105 has a protruding end that is opened. The ink needle 102 is disposed at a center of the guide portion 105. The guide portion 105 is formed in a shape allowing the ink supply portion 34 of the ink cartridge 30 to be inserted into the guide portion 105.

In the process of the ink cartridge 30 to be inserted into the cartridge attachment section 110 in the forward direction 51, that is, in the process of the ink cartridge 30 to be moved to an attached position in the cartridge attachment section 110, the ink supply portion 34 of the ink cartridge 30 is inserted into the guide portion 105. When the ink cartridge 30 is further inserted into the cartridge attachment section 110 in the forward direction 51, the ink needle 102 enters into an ink supply port 71 (see FIG. 3) that is formed in the ink supply portion 34. The ink needle 102 and the ink supply portion 34 can thus be connected to each other. Hence, ink stored in an ink chamber 36 (see FIGS. 4 and 5) formed inside the ink cartridge 30 flows into the corresponding ink tube 20 connected to the ink needle 102 through an internal space 106 (see FIGS. 4 and 5) of the ink supply portion 34 and an internal space 104 (see FIG. 2) of the ink needle 102. The ink needle 102 may have a flat-shaped tip end or a pointed tip end.

<Optical Sensors 121 and 123>

As illustrated in FIG. 2, the optical sensor 121 and the optical sensor 123 are disposed on the inner top surface 115 of the case 101. The optical sensor 121 is an example of a first optical sensor, and the optical sensor 123 is an example of a second optical sensor. The optical sensor 123 is disposed further in the forward direction 51 (i.e. forward) relative to the optical sensor 121. A lower end of the optical sensors 123 is positioned further in the upward direction 54 (i.e. upward) relative to a lower end of the optical sensors 121.

The optical sensor 121 includes a light emitting part (not illustrated) and a light receiving part (not illustrated). The light emitting part of the optical sensor 121 and the light receiving part of the optical sensor 121 are arranged to face each other in the rightward direction 55 and the leftward direction 56. The light emitting part of the optical sensor 121 is disposed at a right end portion of the space 103A in the internal space 103. The light receiving part of the optical sensor 121 is disposed at a left end portion of the space 103A. The right and left positions of the light emitting part of the optical sensor 121 and the light receiving part of the optical sensor 121 may be arranged in reverse.

The optical sensor 123 includes a light emitting part (not illustrated) and a light receiving part (not illustrated). The light emitting part of the optical sensor 123 and the light receiving part of the optical sensor 123 are arranged to face each other in the rightward direction 55 and the leftward direction 56. The light emitting part of the optical sensor 123 is disposed at the right end portion of the space 103A. The light receiving part of the optical sensor 123 is disposed at the left end portion of the space 103A. The right and left positions of the light emitting part of the optical sensor 123 and the light receiving part of the optical sensor 123 may be arranged in reverse.

The optical sensor 121 and the optical sensor 123 are electrically connected to a controller 1 of the printer 10 through an electrical circuit. The controller 1 will be described later in detail.

<Locking Rod 145>

As illustrated in FIG. 2, the locking rod 145 is disposed near the inner top surface 115 of the case 101 and near the opening 112, and extends in the leftward direction 56 and the rightward direction 55. The locking rod 145 is a rod-like member that extends in the leftward direction 56 and the rightward direction 55. The locking rod 145 is, for example, a metal columnar member. Both ends of the locking rod 145 in the leftward direction 56 and the rightward direction 55 are fixed to walls that define both ends of the case 101 in the leftward direction 56 and the rightward direction 55.

The locking rod 145 is adapted to retain the ink cartridge 30 attached to the cartridge attachment section 110 at its attached position. The ink cartridge 30 inserted into the cartridge attachment section 110 is engaged with the locking rod 145. In this way, the ink cartridge 30 is retained in the cartridge attachment section 110.

<Ink Cartridge 30>

Figure 3:
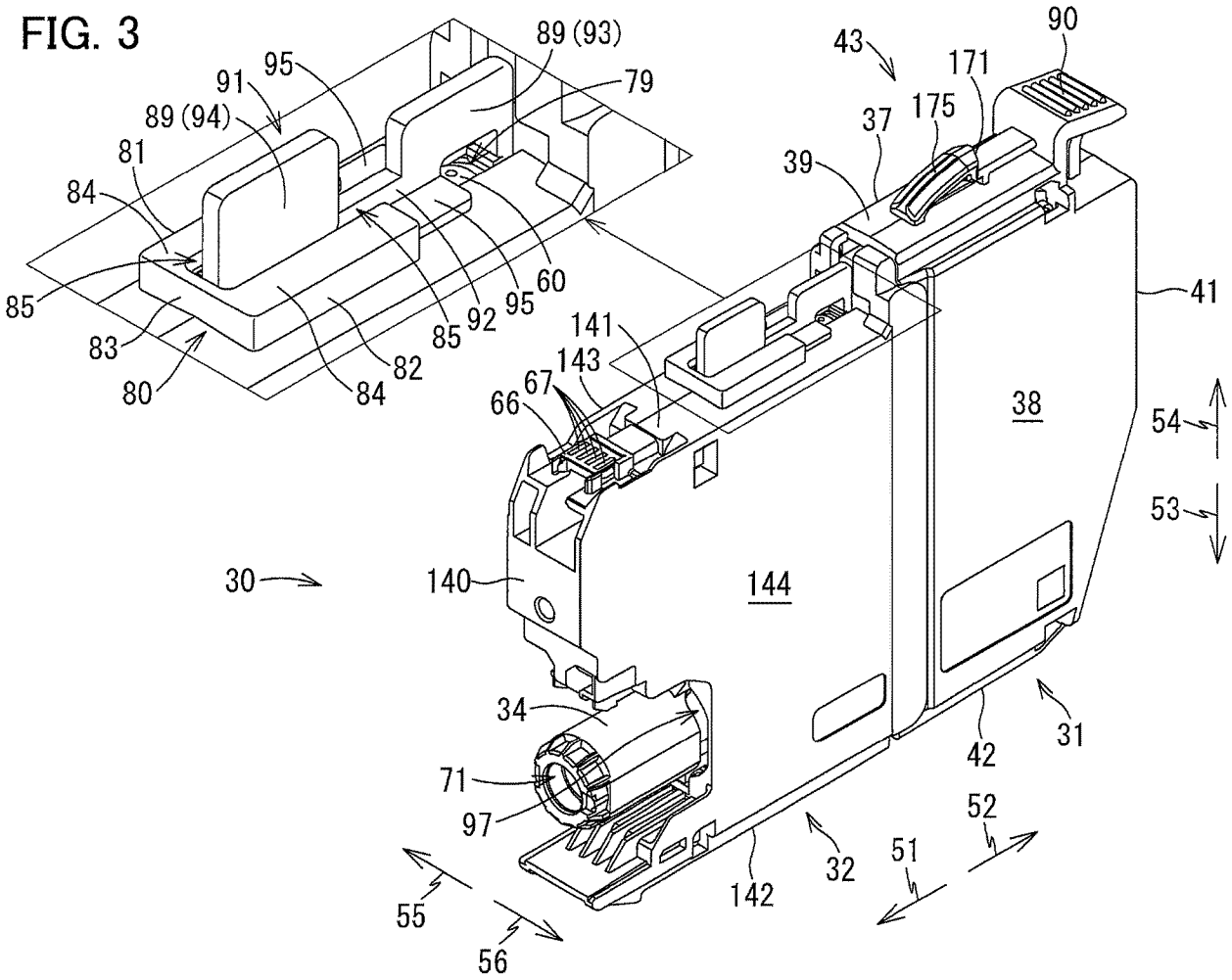
FIG. 3 is a perspective view of the ink cartridge 30.
Figure 4:
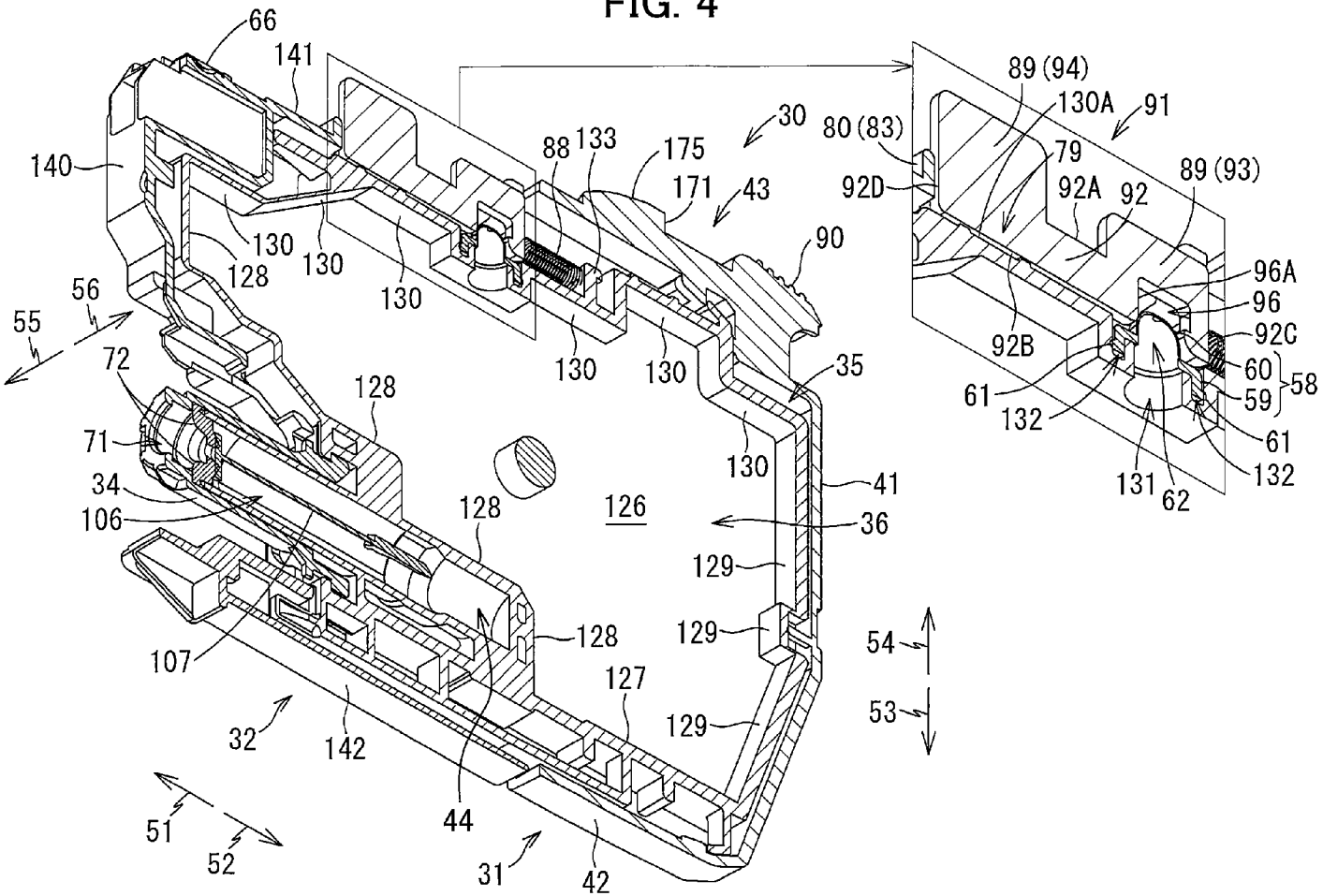
FIG. 4 is a perspective cross-sectional view of the ink cartridge 30.
Figure 5:
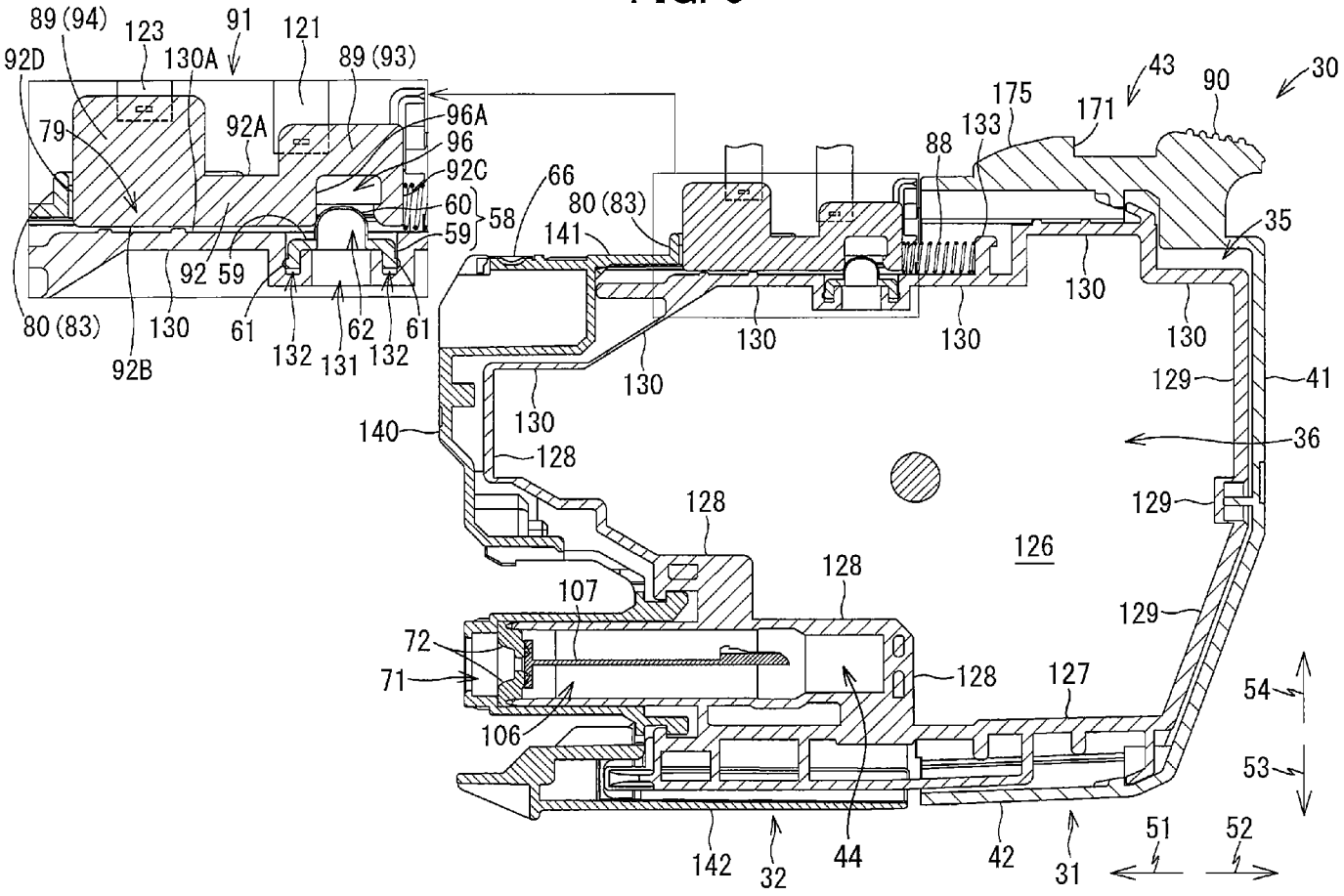
FIG. 5 is a vertical cross-sectional view of the ink cartridge 30 in which a movable member 91 is at a first position.

As illustrated in FIG. 3, the ink cartridge 30 is a container that is configured to store ink therein. As illustrated in FIGS. 4 and 5, a space formed inside the ink cartridge 30 constitutes an ink chamber 36 for storing ink therein. The ink chamber 36 is formed by an inner frame 35. The inner frame 35 is accommodated in a rear cover 31 and a front cover 32. A combination of the rear cover 31 and the front cover 32 provide an external shape of the ink cartridge 30. The ink chamber 36 may be formed by the rear cover 31 and the front cover 32.

The ink cartridge 30 illustrated in FIGS. 1 and 3 through 5 is in a posture attachable to the cartridge attachment section 110 (attached posture), that is, a posture of the ink cartridge 30 when the ink cartridge 30 has been completely attached to the cartridge attachment section 110. As described later in detail, the ink cartridge 30 includes a front wall having a front surface 140, a rear wall having a rear surface 41, upper walls having upper surfaces 39 and 141, lower walls having lower surfaces 42 and 142, right side walls having right side surfaces 37 and 143, and left side walls having left side surfaces 38 and 144. In the posture of the ink cartridge 30 illustrated in FIGS. 1 and 3 through 5, a direction from the rear surface 41 toward the front surface 140 corresponds to the forward direction 51, a direction from the front surface 140 toward the rear surface 41 corresponds to the rearward direction 52, a direction from the upper surfaces 39 and 141 toward the lower surfaces 42 and 142 corresponds to the downward direction 53, and a direction from the lower surfaces 42 and 142 toward the upper surfaces 39 and 141 corresponds to the upward direction 54. In the attached posture of the ink cartridge 30, the downward direction 53 and the upward direction 54 are parallel to the gravitational direction. Further, when the ink cartridge 30 is inserted into the cartridge attachment section 110 and attached to the cartridge attachment section 110, the front surface 140 faces in the forward direction 51, the rear surface 41 faces in the rearward direction 52, the right side surfaces 37 and 143 face in the rightward direction 55, the left side surfaces 38 and 144 face in the leftward direction 56, the lower surfaces 42 and 142 faces in the downward direction 53, and the upper surfaces 39 and 141 face in the upward direction 54. The forward direction 51 is a direction that the ink cartridge 30 is inserted into the cartridge attachment section 110, while the rearward direction 52 is a direction that the ink cartridge 30 is removed from the cartridge attachment section 110. The forward direction 51 and the rearward direction 52 cross the gravitational direction.

As illustrated in FIGS. 3 through 6, the ink cartridge 30 includes the rear cover 31 that is substantially rectangular parallelepiped-shaped, the front cover 32 a part of which constitutes the front surface 140, and the inner frame 35 defining the ink chamber 36 and an ink channel 44. The rear cover 31 and the front cover 32 are attached to the inner frame 35, thereby providing the external shape of the ink cartridge 30. The inner frame 35 is accommodated in the rear cover 31 and the front cover 32. The ink cartridge 30 has an overall flattened shape such that a dimension of the ink cartridge 30 in the rightward direction 55 and the leftward direction 56 is narrow, and a dimension of the ink cartridge 30 in the downward direction 53 and the upward direction 54 and a dimension of the ink cartridge 30 in the forward direction 51 and the rearward direction 52 are greater than the dimension of the ink cartridge 30 in the rightward direction 55 and the leftward direction 56. The rear surface 41 of the rear cover 31 is disposed such that the ink chamber 36 is interposed between the rear surface 41 and the front surface 140 of the front cover 32.

Outer surfaces of the ink cartridge 30 are formed of substantially six surfaces, that is, the front surface 140, the rear surface 41, the upper surfaces 39 and 141, the lower surfaces 42 and 142, the right side surfaces 37 and 143, and the left side surfaces 38 and 144. Of the six surfaces, the right side surfaces 37 and 143 and the left side surfaces 38 and 144 are the greatest in area. The front surface 140 and the rear surface 41 are surfaces that expand in the upward direction 54, the downward direction 53, the rightward direction 55, and the leftward direction 56. The upper surfaces 39 and 141 and the lower surfaces 42 and 142 are surfaces that expand in the forward direction 51, the rearward direction 52, the rightward direction 55, and the leftward direction 56. The right side surfaces 37 and 143 and the left side surfaces 38 and 144 are surfaces that expand in the forward direction 51, the rearward direction 52, the upward direction 54, and the downward direction 53.

Each of the front surface, the rear surface, the upper surface, the lower surface, the right side surface, and the left side surface of the ink cartridge 30 does not necessarily form one flat surface. That is, the front surface is a surface(s) of the ink cartridge 30 that is visible when the ink cartridge 30 is viewed in the rearward direction 52 and that is positioned further in the forward direction 51 (i.e. forward) relative to a center portion of the ink cartridge 30 in the forward direction 51 and the rearward direction 52. The rear surface is a surface(s) of the ink cartridge 30 that is visible when the ink cartridge 30 is viewed in the forward direction 51 and that is positioned further in the rearward direction 52 (i.e. rearward) relative to the center portion of the ink cartridge 30 in the forward direction 51 and the rearward direction 52. The upper surface is a surface(s) of the ink cartridge 30 that is visible when the ink cartridge 30 is viewed in the downward direction 53 and that is positioned further in the upward direction 54 (i.e. upward) relative to a center portion of the ink cartridge 30 in the downward direction 53 and the upward direction 54. The lower surface is a surface(s) of the ink cartridge 30 that is visible when the ink cartridge 30 is viewed in the upward direction 54 and that is positioned further in the downward direction 53 (i.e. downward) relative to the center portion of the ink cartridge 30 in the downward direction 53 and the upward direction 54. The same applies to the right side surface and the left side surface. The right side surface is a surface(s) of the ink cartridge 30 that is visible when the ink cartridge 30 is viewed in the leftward direction 56 and that is positioned further in the rightward direction 55 (i.e. rightward) relative to a center portion of the ink cartridge 30 in the rightward direction 55 and the leftward direction 56. The left side surface is a surface(s) of the ink cartridge 30 that is visible when the ink cartridge 30 is viewed in the rightward direction 55 and that is positioned further in the leftward direction 56 (i.e. leftward) relative to the center portion of the ink cartridge 30 in the rightward direction 55 and the leftward direction 56.

In the embodiment, the upper surface 39 positioned further in the rearward direction 52 (i.e. rearward) relative to the upper surface 141 is positioned higher than the upper surface 141. However, the upper surface 39 and the upper surface 141 may be disposed at the same height, that is, the same position in the downward direction 53 and the upward direction 54.

<Rear Cover 31>

As illustrated in FIG. 3, the rear cover 31 is formed in a box-like shape having one end that opens in the forward direction 51. Specifically, the rear cover 31 includes the right side wall having the right side surface 37, the left side wall having the left side surface 38, the upper wall having the upper surface 39, the rear wall having the rear surface 41, and the lower wall having the lower surface 42. The rear cover 31 is configured such that the right side surface 37 and the left side surface 38 are arranged spaced apart from each other in the rightward direction 55 and the leftward direction 56, the upper surface 39 faces in the upward direction 54, the lower surface 42 faces in the downward direction 53, and the right side surface 37, the left side surface 38, the upper surface 39, and the lower surface 42 extend from the rear surface 41 in the forward direction 51. The inner frame 35 is inserted into the rear cover 31 through the front opening of the rear cover 31. That is, the rear cover 31 covers a rear portion of the inner frame 35.

A locking portion 43 is provided on the upper surface 39 of the rear cover 31. The locking portion 43 protrudes in the upward direction 54 from the upper surface 39. The locking portion 43 extends in the forward direction 51 and the rearward direction 52 on the upper surface 39. The locking portion 43 has a surface facing in the rearward direction 52 that serves as a locking surface 171. The locking surface 171 extends in the downward direction 53 and the upward direction 54. The locking surface 171 is a surface capable of contacting the locking rod 145 of the cartridge attachment section 110 rearward in the rearward direction 52 when the ink cartridge 30 has been attached to the cartridge attachment section 110. When the locking surface 171 contacts the locking rod 145 rearward in the rearward direction 52, the locking portion 43 and the locking rod 145 are engaged with each other. As a result, the ink cartridge 30 is retained in the cartridge attachment section 110.

The locking portion 43 also has an inclined surface 175 at a position further in the forward direction 51 (i.e. forward) relative to the locking surface 171. The inclined surface 175 faces in the upward direction 54 and the forward direction 51.

An operation portion 90 is provided on the upper surface 39 of the rear cover 31 at a position further in the rearward direction 52 (i.e. rearward) relative to the locking surface 171. In a state where the ink cartridge 30 is attached to the cartridge attachment section 110, the user operates the operation portion 90 to remove the ink cartridge 30 from the cartridge attachment section 110.

<Front Cover 32>

As illustrated in FIG. 3, the front cover 32 is formed in a box-like shape having one end that opens in the rearward direction 52. Specifically, the front cover 32 includes the front wall having the front surface 140, the upper wall having the upper surface 141, the lower wall having the lower surface 142, the right side wall having the right side surface 143, and the left side wall having the left side surface 144. The front cover 32 is configured such that the right side surface 143 and the left side surface 144 are arranged spaced apart from each other in the rightward direction 55 and the leftward direction 56, the upper surface 141 and the lower surface 142 are arranged spaced apart from each other in the downward direction 53 and the upward direction 54, and the right side surface 143, the left side surface 144, the upper surface 141, and the lower surface 142 extend from the front surface 140 in the rearward direction 52. The inner frame 35 is inserted into the front cover 32 through the rear opening of the front cover 32. That is, the front cover 32 covers a front portion of the inner frame 35 that is not covered with the rear cover 31.

A hole 97 is formed in the front wall of the front cover 32 at a lower portion thereof. The hole 97 penetrates the front wall of the front cover 32 in the rearward direction 52. The hole 97 allows the ink supply portion 34 of the inner frame 35 to be exposed to an outside in a state where the inner frame 35 is inserted into the front cover 32. Hence, the hole 97 is formed so as to have a position, a dimension, and a shape corresponding to the ink supply portion 34.

As illustrated in FIGS. 3 through 5, an elongated hole 79 is formed in the upper wall of the front cover 32. The elongated hole 79 extends in the forward direction 51 and the rearward direction 52. A movable member 91 (described later) protrudes in the upward direction 54, through the elongated hole 79, from a position further in the downward direction 53 (i.e. downward) relative to the upper surface 141 of the front cover 32.

As illustrated in FIG. 3, a guide portion 80 is provided on the upper surface 141 of the front cover 32 to surround a part of the elongated hole 79. In other words, the guide portion 80 is formed at a position to surround a part of the movable member 91 that protrudes through the elongated hole 79. The guide portion 80 includes a right wall 81, a left wall 82, a front wall 83, and an upper wall 84. The right wall 81 is elongated in the forward direction 51 and the rearward direction 52 and protrudes in the upward direction 54 from the upper surface 141 at a position further in the rightward direction 55 (i.e. rightward) relative to the elongated hole 79. The left wall 82 is elongated in the forward direction 51 and the rearward direction 52 and protrudes in the upward direction 54 from the upper surface 141 at a position further in the leftward direction 56 (i.e. leftward) relative to the elongated hole 79. The front wall 83 protrudes in the upward direction 54 from the upper surface 141 at a position further in the forward direction 51 (i.e. forward) relative to the elongated hole 79. The upper wall 84 is connected to an upper end of the right wall 81, an upper end of the left wall 82, and an upper end of the front wall 83. A recess 85 is formed in the upper wall 84. The recess 85 is recessed in the forward direction 51 from a rear end of the upper wall 84. The recess 85 faces the elongated hole 79 in the upward direction 54 and the downward direction 53.

The right wall 81 restricts movement of the movable member 91 in the rightward direction 55. The left wall 82 restricts movement of the movable member 91 in the leftward direction 56. The front wall 83 restricts movement of the movable member 91 in the forward direction 51. The upper wall 84 restricts movement of the movable member 91 in the upward direction 54. A second detection portion 94 (described later) of the movable member 91 protrudes in the upward direction 54 through the recess 85 to a position further in the upward direction 54 (i.e. upward) relative to the upper wall 84. That is, the second detection portion 94 protrudes in the upward direction 54 to a position higher than the upper wall 84.

Further, an IC board 66 is provided on the upper surface 141 of the front cover 32 at a position further in the forward direction 51 (i.e. forward) relative to the movable member 91. Four electrodes 67 are provided on an upper surface of the IC board 66. The electrodes 67 extend in the forward direction 51 and the rearward direction 52 on the upper surface of the IC board 66, and are arranged spaced apart from one another in the leftward direction 56 and the rightward direction 55. The electrodes 67 include a HOT electrode, a GND electrode, a signal electrode, and the like, for example. An IC (not illustrated) provided on the IC board 66 is electrically connected to each of the electrodes 67. The IC is a semiconductor integrated circuit that stores data indicative of information of the ink cartridge 30 (type information) such as a lot number and manufactured date, for example, in a readable format. In a state where the ink cartridge 30 is attached to the cartridge attachment section 110, the IC is electrically connected to the controller 1 (see FIGS. 1 and 7) of the printer 10 through the respective electrodes 67. The controller 1 determines the type of the attached ink cartridge 30 and the like based on data read from the IC board 66.

<Inner Frame 35>

The inner frame 35 (an example of a casing) is made of a resin. The inner frame 35 is formed in a box-like shape whose left end is open. As illustrated in FIGS. 4 and 5, the inner frame 35 includes a right wall 126, a lower wall 127, a front wall 128, a rear wall 129, and an upper wall 130. The open left end of the inner frame 35 is sealed with a film (not illustrated), thereby forming the ink chamber 36 that is capable of storing ink therein.

The right wall 126 expands in the forward direction 51, the rearward direction 52, the upward direction 54, and the downward direction 53. The lower wall 127 protrudes in the leftward direction 56 from a lower end portion of the right wall 126. The lower wall 127 expands in the forward direction 51, the rearward direction 52, the rightward direction 55, and the leftward direction 56.

The front wall 128 protrudes in the leftward direction 56 from a front end portion of the right wall 126. The rear wall 129 protrudes in the leftward direction 56 from a rear end portion of the right wall 126. That is, the rear wall 129 is spaced apart from the front wall 128 in the rearward direction 52. Further, the ink chamber 36 is disposed between the front wall 128 and the rear wall 129. The upper wall 130 protrudes in the leftward direction 56 from an upper end portion of the right wall 126. The upper wall 130 is positioned between the front wall 128 and the rear wall 129. An upper end portion of the front wall 128 is connected to the upper wall 130. An upper end portion of the rear wall 129 is connected to the upper wall 130. A lower end portion of the front wall 128 is connected to the lower wall 127. A lower end portion of the rear wall 129 is connected to the lower wall 127.

The front wall 128 and the rear wall 129 expand in the rightward direction 55, the leftward direction 56, the upward direction 54, and the downward direction 53. The upper wall 130 expands in the forward direction 51, the rearward direction 52, the rightward direction 55, and the leftward direction 56.

The ink chamber 36 is defined by the right wall 126, the lower wall 127, the front wall 128, the rear wall 129, the upper wall 130, and the film (not illustrated).

The ink chamber 36 communicates with an outside thereof through the ink supply port 71 only. In other words, other than the ink supply port 71 of the ink supply portion 34, the ink cartridge 30 has no air passage through which the ink chamber 36 communicates with ambient air. Hence, when ink stored in the ink chamber 36 flows into the ink tube 20 through the ink needle 102 while the ink needle 102 is in connection with the ink supply portion 34, an internal pressure of the ink chamber 36 is reduced.

The inner frame 35 may include a left wall instead of the right wall 126. In this case, the inner frame 35 may have an open right end, and the open right end may be sealed with a film. Further, the inner frame 35 may include a left wall in addition to the right wall 126. That is, at least one of a right wall and a left wall that are side walls defining a right end and a left end of the ink chamber 36 may be made of a resin.

The upper wall 130 has a through hole 131, a recessed portion 132, and a protruding portion 133.

The through hole 131 has a circular shape in a plan view. However, the through hole 131 may have a shape other than the circular shape. The recessed portion 132 is formed on an upper surface 130A of the upper wall 130 to surround the through hole 131. The recessed portion 132 has an annular shape in a plan view. However, the recessed portion 132 may have a shape other than the annular shape. A deformable member 58 (described later) is fitted with the recessed portion 132. Hence, the deformable member 58 covers the through hole 131 so as to close the through hole 131 in the upward direction 54. That is, the deformable member 58 covers the through hole 131 from above.

The protruding portion 133 protrudes in the upward direction 54 from the upper surface 130A of the upper wall 130. The protruding portion 133 is provided at a position further in the rearward direction 52 (i.e. rearward) relative to the through hole 131 and the recessed portion 132. The protruding portion 133 is positioned immediately below the locking portion 43 in a state where the inner frame 35 is covered with the rear cover 31. A coil spring 88 (described later) is connected to the protruding portion 133.

<Ink Supply Portion 34>

As illustrated in FIGS. 4 and 5, the ink supply portion 34 (an example of a liquid supply portion) is disposed at a lower portion of the front wall 128 and protrudes in the forward direction 51. The ink supply portion 34 is formed in a substantially cylindrical shape. The ink supply portion 34 has a front end in which the ink supply port 71 is formed. The ink supply port 71 provides communication between an internal space 106 of the ink supply portion 34 and the outside of the ink cartridge 30. An opening (not illustrated) is formed in a rear end of the ink supply portion 34. The opening provides communication between the internal space 106 and the ink chamber 36.

The ink supply portion 34 is provided with a valve 107. The valve 107 is disposed in the internal space 106. The valve 107 is urged in the forward direction 51 by a coil spring (not illustrated). As the coil spring urges the valve 107 in the forward direction 51, the valve 107 contacts an annular-shaped seal member 72 provided in the ink supply port 71 and closes the ink supply port 71. Accordingly, ink in the ink channel 44 is prevented from flowing out of the ink cartridge 30 through the ink supply port 71.

During the process of the ink cartridge 30 being inserted into the cartridge attachment section 110 in the forward direction 51, the ink needle 102 (see FIG. 2) enters into the internal space 106 of the ink supply portion 34 through the ink supply port 71 and pushes the valve 107. The valve 107 is thus moved in the rearward direction 52 against an urging force of the coil spring. As a result, ink in the ink channel 44 flows into the ink tube 20 connected to the ink needle 102 through the internal space 106 of the ink supply portion 34 and the internal space 104 (see FIG. 2) of the ink needle 102.

Incidentally, an opening (not illustrated) is formed at a side surface of the ink needle 102. Ink in the internal space 106 of the ink supply portion 34 can flow into the internal space 104 through the opening of the ink needles 102. Further, the ink needle 102 has a diameter greater than an inner diameter of the seal member 72. The ink needle 102 is inserted into the seal member 72 while pushing the seal member 72 radially outward. No gap is thus formed between the ink needle 102 and the seal member 72 in a state where the ink needle 102 enters into the seal member 72. Therefore, leakage of ink between the ink needle 102 and the seal member 72 can be prevented.

The ink supply portion 34 is not limited to a structure including the valve 107. For example, the ink supply port 71 may be closed by a film. In this case, when the ink cartridge 30 is attached to the cartridge attachment section 110, the ink needle 102 pierces through the film. Accordingly, a tip end portion of the ink needle 102 enters into the internal space 106 of the ink supply portion 34 through the ink supply port 71.

<Deformable Member 58>

The deformable member 58 is made of an elastic material, such as silicone, rubber, or the like. That is, the deformable member 58 has an elasticity. As illustrated in FIGS. 4 and 5, the deformable member 58 includes a cylindrical-shaped fitting portion 59, and a bulging portion 60 that bulges from one end of the fitting portion 59 and has a dome-like shape. The fitting portion 59 has a diameter substantially equal to a diameter of the recessed portion 132. The fitting portion 59 is fitted with the recessed portion 132, whereby the deformable member 58 is attached to the upper wall 130. The fitting portion 59 has a projecting portion 61 that extends radially from an outer peripheral surface of the fitting portion 59. When the fitting portion 59 is fitted with the recessed portion 132, the projecting portion 61 is elastically deformed so as to be radially compressed. A portion where the fitting portion 59 and the recessed portion 132 are fitted with each other is liquid-tightly sealed.

In a state where the deformable member 58 is attached to the upper wall 130, the bulging portion 60 bulges (inflates) further in the upward direction 54 (an example of a cross direction) relative to a part of the upper surface 130A of the upper wall 130 where the recessed portion 132 is formed. That is, the bulging portion 60 protrudes in the upward direction 54 from the upper surface 130A of the upper wall 130. The bulging portion 60 has an internal space 62 that is in communication with the ink chamber 36 through the through hole 131. When the internal pressure of the ink chamber 36 is reduced, the bulging portion 60 is pulled in the downward direction 53 and is elastically deformed so as to deflate in the downward direction 53. In other words, the bulging portion 60 is elastically deformed such that dimension of the bulging portion 60 in the upward direction 54 becomes smaller in accordance with reduction in the internal pressure of the ink chamber 36. Note that the ink chamber 36 and the internal space 62 of the bulging portion 60 can communicate with an outside of the ink cartridge 30 only through the ink supply portion 34 when the ink cartridge 30 has been attached to the cartridge attachment section 110.

<Movable Member 91>

As illustrated in FIGS. 4 and 5, the movable member 91 is supported by the upper surface 130A of the upper wall 130 so as to be movable in the forward direction 51 and the rearward direction 52. That is, the movable member 91 is slidingly movable in the forward direction 51 and the rearward direction 52 along the upper wall 130 of the inner frame 35. In other words, the movable member 91 is linearly movable relative to the upper wall 130 of the inner frame 35 in the forward direction 51 and the rearward direction 52.

The movable member 91 includes a main body 92, a detection portion 89, a recess 96, and a pair of protrusions 95 (see FIG. 3). In this embodiment, the detection portion 89 includes a first detection portion 93 and the second detection portion 94.

The main body 92 is formed in a substantially rectangular shape. A lower surface 92B (an example of a supported surface) of the main body 92 is in contact with the upper surface 130A of the upper wall 130. The movable member 91 is thus supported by the upper wall 130. A rear portion of the main body 92 is positioned immediately above the deformable member 58. Incidentally, the main body 92 may be positioned immediately above only a part of the deformable member 58. That is, the movable member 91 is disposed such that at least a part of the movable member 91 overlaps the deformable member 58 in a plan view The detection portion 89 is adapted to be detected by blocking or attenuating light emitted from an outside (i.e. the optical sensor 121 and the optical sensors 123). That is, the detection portion 89 is configured to be detected from an exterior of the liquid cartridge. More specifically, when light outputted from the light emitting part of each of the optical sensor 121 and the optical sensor 123 reaches one of left and right surfaces of the detection portion 89, intensity (transmission state) of light passing through the other of the left and right surfaces of the detection portion 89 and reaching the corresponding light receiving part of each of the optical sensor 121 and the optical sensor 123 becomes less than a prescribed intensity, e.g., 0 (zero). The detection portion 89 may completely block the light traveling in the rightward direction 55 or the leftward direction 56, may partially absorb the light, may deflect the light, or may fully reflect the light.

The first detection portion 93 protrudes in the upward direction 54 from a rear portion of an upper surface 92A (an example of an opposite surface) of the main body 92. The second detection portion 94 protrudes in the upward direction 54 from a front portion of the upper surface 92A of the main body 92. The second detection portion 94 and the first detection portion 93 are spaced apart from each other in the forward direction 51 and the rearward direction 52. An upper end of the second detection portion 94 is positioned higher than an upper end of the first detection portion 93 in the upward direction 54 and the downward direction 53. That is, the second detection portion 94 protrudes further in the upward direction 54 (i.e. upward) relative to the first detection portion 93.

As illustrated in FIG. 3, the first detection portion 93 and the second detection portion 94 protrude, through the elongated hole 79, further in the upward direction 54 (i.e. upward) relative to the upper surface 141 of the front cover 32. The second detection portion 94 protrudes, through the recess 85 of the guide portion 80, further in the upward direction 54 (i.e. upward) relative to the upper wall 84 of the guide portion 80. In other words, the detection portion 89 protrudes further in the upward direction 54 (i.e. upward) relative to the upper wall 130.

In this embodiment, the first detection portion 93 and the second detection portion 94 are described as two separate portions that respectively extend in the upward direction 54 from an upper end of the main body 92. However, for example, the detection portion 89 may be a single plate-like member having a through hole. A portion of the detection portion 89 rearward of the through-hole and a portion of the detection portion 89 forward of the through-hole may serve as the first detection portion 93 and the second detection portion 94.

As illustrated in FIGS. 4 and 5, the recess 96 is recessed in the upward direction 54 from a rear portion of the lower surface 92B of the main body 92. The bulging portion 60 of the deformable member 58 is positioned within the recess 96. The coil spring 88 urges the movable member 91 to cause a front surface 96A defining a portion of the recess 96 to contact the bulging portion 60 from a downstream side thereof in the forward direction 51. In other words, the front surface 96A of the recess 96 is in contact with a front end portion of the bulging portion 60.

As illustrated in FIG. 3, the pair of protrusions 95 protrude from right and left surfaces of the main body 92 in the rightward direction 55 and the leftward direction 56, respectively. One of the pair of protrusions 95 protrudes in the rightward direction 55 from the right surface of the main body 92, while the other of the pair of protrusions 95 protrudes in the leftward direction 56 from the left surface of the main body 92. Movement of the movable member 91 in the rightward direction 55 is restricted upon contact of a right end of the one of the pair of protrusions 95 with the right wall 81 of the guide portion 80. Movement of the movable member 91 in the leftward direction 56 is restricted upon contact of a left end of the other of the pair of protrusions 95 with the left wall 82 of the guide portion 80. Movement of the movable member 91 in the upward direction 54 is restricted upon contact of upper ends of the pair of protrusions 95 with the upper wall 84 of the guide portion 80.

The coil spring 88 is a tension coil spring in this embodiment. As illustrated in FIGS. 4 and 5, the coil spring 88 (an example of an urging member) is disposed between the movable member 91 and the protruding portion 133 formed on the upper wall 130. That is, the coil spring 88 is positioned further in the rearward direction 52 (i.e. rearward) relative to the movable member 91. Further, the coil spring 88 is disposed between the locking portion 43 and the upper wall 130 in the upward direction 54 and the downward direction 53. That is, the coil spring 88 is positioned further in the downward direction 53 (i.e. downward) relative to the locking portion 43. One end of the coil spring 88 is engaged with a rear surface 92C of the main body 92, while the other end of the coil spring 88 is engaged with the protruding portion 133. The urging member is not limited to the coil spring 88. The urging member may be a leaf spring or a member, such as a magnet, that urges the movable member 91 by a magnetic force.

Figure 6:
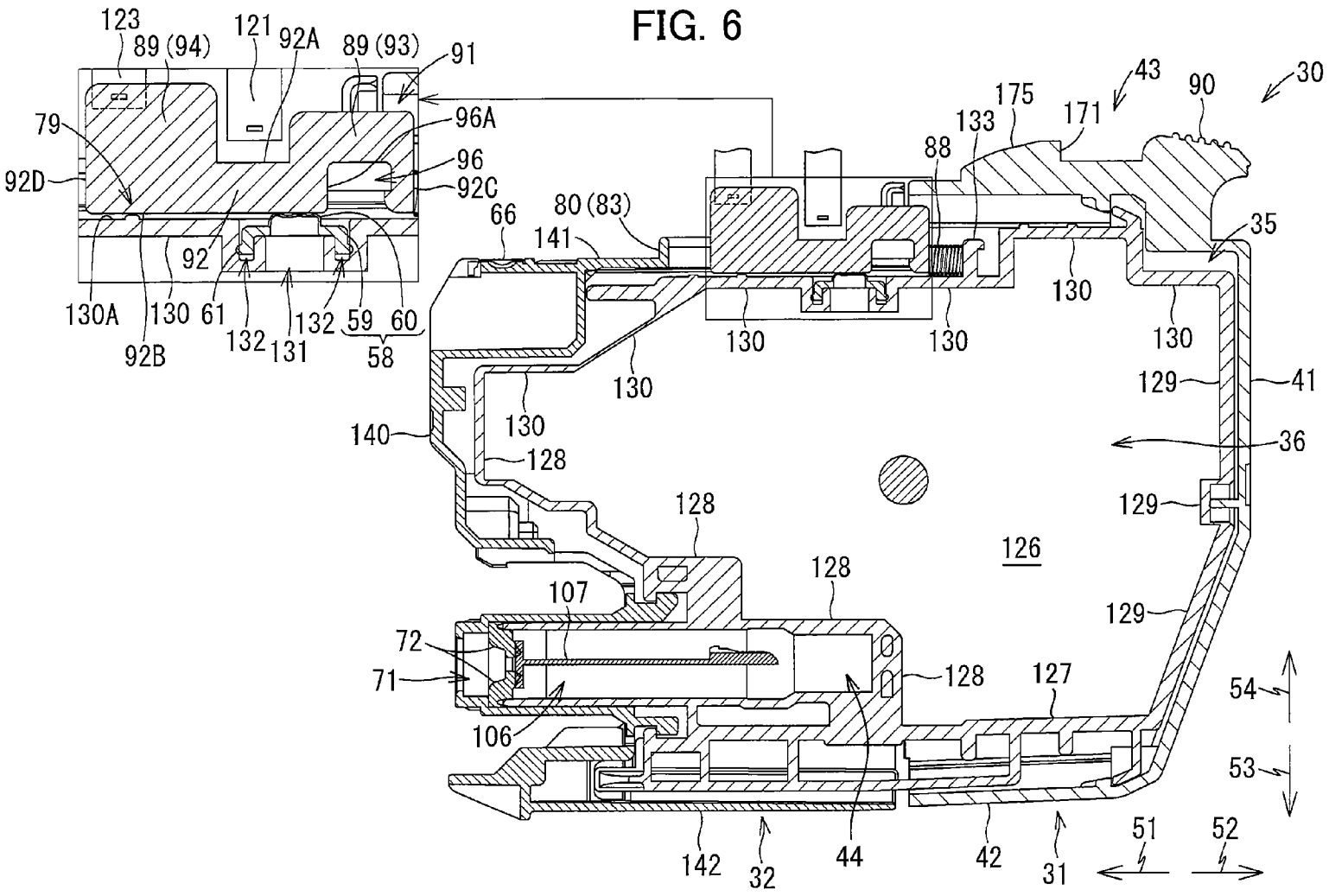
FIG. 6 is a vertical cross-sectional view of the ink cartridge 30 in which the movable member 91 is at a second position.

The movable member 91 is movable in the forward direction 51 and the rearward direction 52 to a first position illustrated in FIG. 5 and to a second position illustrated in FIG. 6. In the first position, the movable member 91 is in contact with the deformable member 58. The second position is positioned further in an urging direction of the coil spring 88 relative to the first position.

The coil spring 88 has a length longer than its natural length when the movable member 91 is at the first position. The coil spring 88 thus urges the movable member 91 toward the deformable member 58. That is, the coil spring 88 urges the movable member 91 in the rearward direction 52. Further, as the coil spring 88 urges the movable member 91 at the first position in the rearward direction 52, the front surface 96A contacts the bulging portion 60 from a downstream side thereof in the forward direction 51. At this time, the internal pressure of the ink chamber 36 maintains the bulging portion 60 at its inflated (i.e. distended) state. Accordingly, at this time, the internal pressure of the ink chamber 36 applied to the bulging portion 60 is greater than or balanced with the urging force of the coil spring 88. When the front surface 96A contacts the bulging portion 60 from a downstream side thereof in the forward direction 51, the bulging portion 60 retains the movable member 91 at the first position against the urging force in the rearward direction 52 applied to the movable member 91 by the coil spring 88. Hence, movement of the movable member 91 in the rearward direction 52 is restricted. The front surface 96A is an example of a contact portion.

Further, when the movable member 91 is at the first position, contact of a front surface 92D of the main body 92 with the front wall 83 of the guide portion 80 can restrict the movable member 91 from moving in the forward direction 51.

The second position of the movable member 91 is positioned further rearward relative to the first position of the movable member 91. That is, the movable member 91 at the second position is positioned further in the rearward direction 52 (i.e. rearward) relative to the movable member 91 at the first position. In other words, the movable member 91 at the second position is positioned further downstream in the urging direction of the coil spring 88 relative to the movable member 91 at the first position. At this time, the coil spring 88 has a length equal to the natural length thereof. That is, the movable member 91 stops at the second position as the coil spring 88 returns to its natural length from the length longer than the natural length.

The detection portion 89 is provided at the movable member 91. Therefore, in accordance with the movement of the movable member 91, the detection portion 89 can also be moved, integrally with the movable member 91, in the forward direction 51 and the rearward direction 52 to a third position illustrated in FIG. 5 and to a fourth position illustrated in FIG. 6. That is, the detection portion 89 is at the third position when the movable member 91 is at the first position, and the detection portion 89 is at the fourth position when the movable member 91 is at the second position. The fourth position of the detection portion 89 is positioned further rearward relative to the third position of the movable member 91. That is, the detection portion 89 at the fourth position is positioned further in the rearward direction 52 (i.e. rearward) relative to the detection portion 89 at the third position. In other words, the fourth position is a different position from the third position.

<Controller 1>

Figure 7:
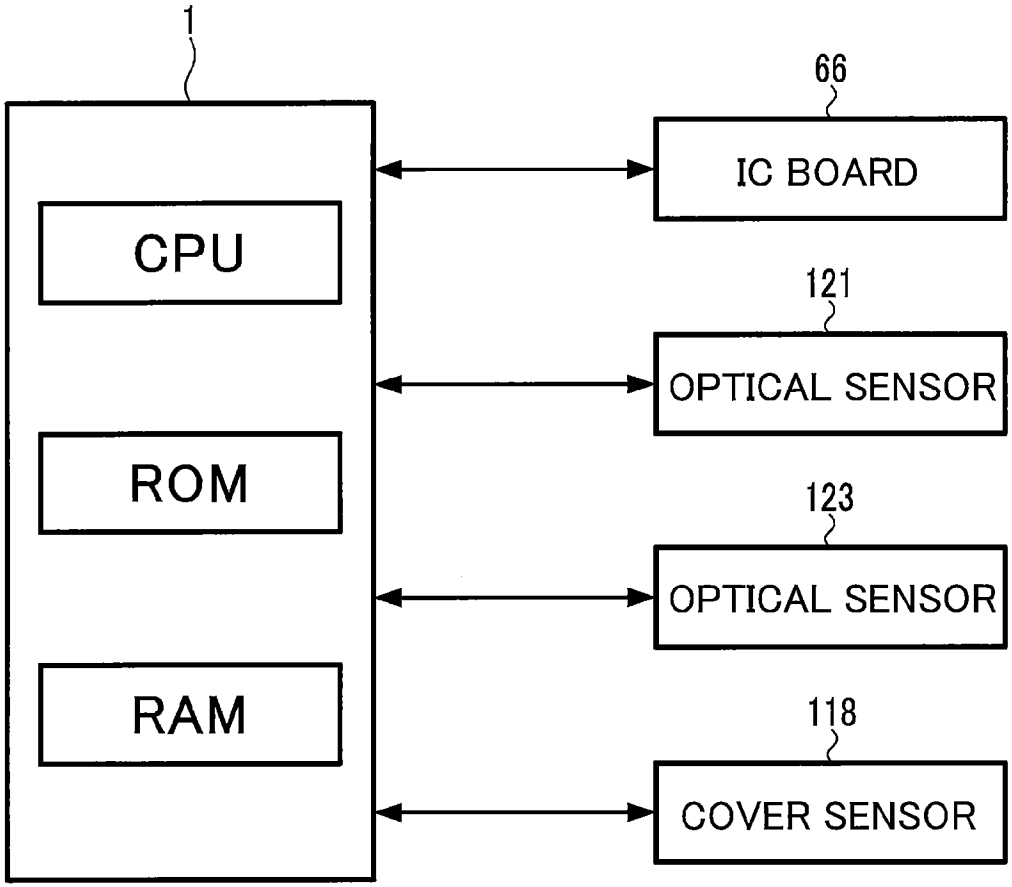
FIG. 7 is a functional block diagram of the printer 10.

The printer 10 includes the controller 1 illustrated in FIG. 7. The controller 1 includes a CPU, a ROM, a RAM, and the like, for example. The controller 1 may be disposed inside a housing of the printer 10 as a control board for controlling the printer 10 or may be provided in the case 101 as a separate control board that is independent from a controller for the printer 10. The controller 1 is connected to the IC board 66, the optical sensor 121, the optical sensor 123, and the cover sensor 118 so as to be capable of transmitting and receiving electrical signals to and from the IC board 66, the optical sensor 121, the optical sensor 123, and the cover sensor 118. The controller 1 is also connected to other components, such as a motor and a touch screen, so as to be capable of transmitting and receiving electrical signals to and from these components, but these components are omitted in FIG. 7. A program that causes the controller 1 to execute various processes is stored in the ROM. The CPU performs computations and issues commands to the components connected to the controller 1 in order to execute the processes based on the program stored in the ROM. The RAM functions as a memory that temporarily stores various information.

The optical sensor 121 transmits a high level signal to the controller 1 when the light receiving part of the optical sensor 121 receives light emitted in the leftward direction 56 from the light emitting part of the optical sensor 121 to the light receiving part of the optical sensor 121. The optical sensor 121 transmits a low level signal to the controller 1 when the light receiving part of the optical sensor 121 does not receive light emitted in the leftward direction 56 from the light emitting part of the optical sensor 121 to the light receiving part of the optical sensor 121.

The optical sensor 123 transmits a high level signal to the controller 1 when the light receiving part of the optical sensor 123 receives light emitted in the leftward direction 56 from the light emitting part of the optical sensor 123 to the light receiving part of the optical sensor 123. The optical sensor 123 transmits a low level signal to the controller 1 when the light receiving part of the optical sensor 123 does not receive light emitted in the leftward direction 56 from the light emitting part of the optical sensor 123 to the light receiving part of the optical sensor 123.

<Detection of Attachment and Detection of Ink Remaining Amount>

Next, detection of attachment of ink cartridge 30 to the cartridge attachment section 110 with the use of the optical sensor 123 and detection of a remaining amount of ink in the ink chamber 36 with the use of the optical sensor 121 will be described.

In the cartridge attachment section 110 into which the ink cartridge 30 has not yet been inserted as illustrated in FIG. 2, nothing is present between the light emitting part of the optical sensor 121 and the light receiving part of the optical sensor 121, so that light emitted from the light emitting part of the optical sensor 121 is not interrupted. Further, nothing is present between the light emitting part of the optical sensor 123 and the light receiving part of the optical sensor 123, so that light emitted from the light emitting part of the optical sensor 123 is not interrupted.

Figure 8A:
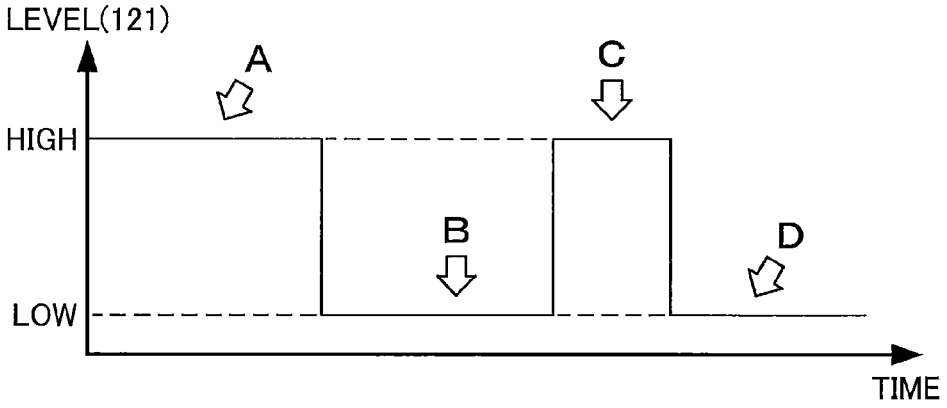
FIG. 8A is a timing chart illustrating changes in signal outputted from an optical sensor 121 during the process of the ink cartridge 30 being inserted into the cartridge attachment section 110.
Figure 8B:
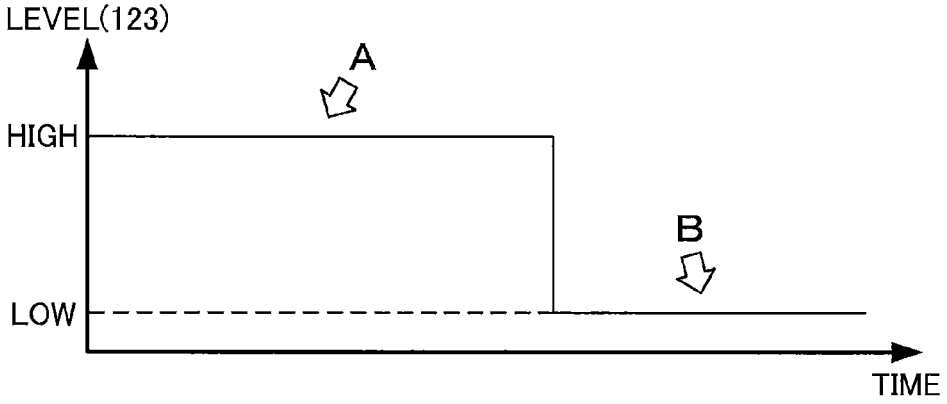
FIG. 8B is a timing chart illustrating a change in signal outputted from an optical sensor 123 during the process of the ink cartridge 30 being inserted into the cartridge attachment section 110.
Figure 8C:
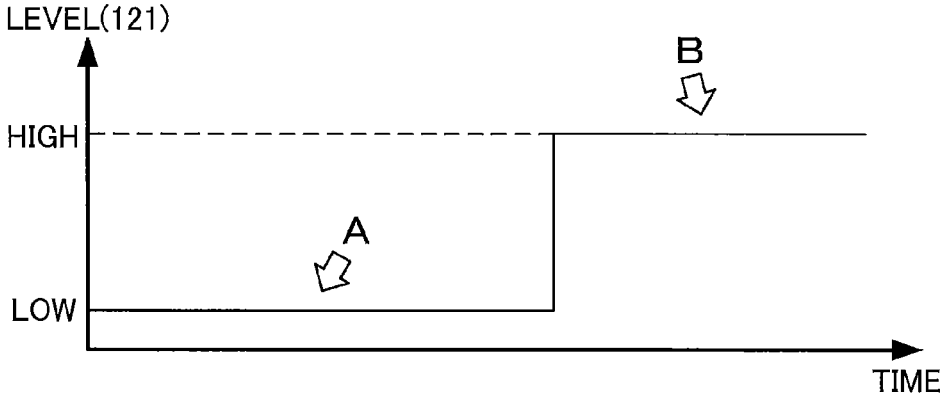
FIG. 8C is a timing chart illustrating a change in signal outputted from the optical sensor 121 during the process of ink stored in the ink cartridge 30 being consumed.

Accordingly, the optical sensor 121 transmits a high level signal to the controller 1 as indicated by an arrow "A" in FIG. 8A. Further, the optical sensor 123 transmits a high level signal to the controller 1 as indicated by an arrow "A" in FIG. 8B.

Further, in the ink cartridge 30 that has not yet been inserted into the cartridge attachment section 110 as illustrated in FIGS. 3 and 4, the bulging portion 60 of the deformable member 58 protrudes, through the through hole 131, further in the upward direction 54 (i.e. upward) relative to a part of the upper surface 130A of the upper wall 130. The movable member 91 is disposed at the first position, and the detection portion 89 (the first detection portion 93 and the second detection portion 94) is disposed at the third position. That is, the front surface 96A of the recess 96 of the movable member 91 contacts the bulging portion 60 from a downstream side thereof in the forward direction 51 by the urging force oriented in the rearward direction 52 of the coil spring 88.

When the ink cartridge 30 is inserted in the forward direction 51 into the cartridge attachment section 110 after the cover of the cartridge attachment section 110 is opened, the inclined surface 175 of the locking portion 43 abuts against the locking rod 145 to be pressed by the locking rod 145. The locking portion 43 is thereby moved in the downward direction 53. When the ink cartridge 30 is inserted further in the forward direction 51, the inclined surface 175 moves past the locking rod 145 in the forward direction 51. The locking portion 43 is no longer pressed by the locking rod 145 at this time. Accordingly, the locking portion 43 is moved in the upward direction 54. As a result, the locking surface 171 faces the locking rod 145 rearward in the rearward direction 52. The ink cartridge 30 is thus fixed in position in the cartridge attachment section 110 and completely attached to the cartridge attachment section 110.

When the ink cartridge 30 is removed from the cartridge attachment section 110 in the rearward direction 52, the operation portion 90 is pressed in the downward direction 53 to move the locking portion 43 in the downward direction 53. Accordingly, the locking surface 171 is positioned further in the downward direction 53 (i.e. downward) relative to the locking rod 145. As a result, the ink cartridge 30 can be removed from the cartridge attachment section 110 without being blocked by the locking rod 145.

When the ink cartridge 30 is inserted in the forward direction 51 into the cartridge attachment section 110, the second detection portion 94 is positioned between the light emitting part of the optical sensor 121 and the light receiving part of the optical sensor 121. The signal transmitted from the optical sensor 121 to the controller 1 thus changes from a high level signal to a low level signal as indicated by an arrow "B" in FIG. 8A. At this time, no portion of the ink cartridge 30 is present between the light emitting part of the optical sensor 123 and the light receiving part of the optical sensor 123, and hence, light emitted from the light emitting part of the optical sensor 123 is not interrupted. Therefore, the signal transmitted from the optical sensor 123 to the controller 1 remains unchanged, that is, the optical sensor 123 keeps transmitting a high level signal to the controller 1.

When the ink cartridge 30 is further inserted into the cartridge attachment section 110, the second detection portion 94 is positioned further in the forward direction 51 (i.e. forward) relative to the optical sensor 121. The signal transmitted from the optical sensor 121 to the controller 1 thus changes from a low level signal to a high level signal as indicated by an arrow "C" in FIG. 8A. The second detection portion 94 is positioned between the light emitting part of the optical sensor 123 and the light receiving part of the optical sensor 123. The signal transmitted from the optical sensor 123 to the controller 1 thus changes from a high level signal to a low level signal as indicated by an arrow "B" in FIG. 8B.

When the ink cartridge 30 is further inserted into the cartridge attachment section 110 and the ink cartridge 30 is completely attached to the cartridge attachment section 110, the first detection portion 93 is positioned between the light emitting part of the optical sensor 121 and the light receiving part of the optical sensor 121, and the second detection portion 94 is positioned between the light emitting part of the optical sensor 123 and the light receiving part of the optical sensor 123, as illustrated in FIG. 5. That is, the first detection portion 93 blocks light emitted from the light emitting part of the optical sensor 121, and the second detection portion 94 blocks light emitted from the light emitting part of the optical sensor 123. The signal transmitted from the optical sensor 121 to the controller 1 thus changes from a high level signal to a low level signal as indicated by an arrow "D" in FIG. 8A. The signal transmitted from the optical sensor 123 to the controller 1 remains unchanged, that is, the optical sensor 123 keeps transmitting a low level signal to the controller 1.

After the ink cartridge 30 is completely attached to the cartridge attachment section 110, the cover of the cartridge attachment section 110 is closed.

During the process of the ink cartridge 30 being inserted into the cartridge attachment section 110, the movable member 91 does not move relative to inner frame 35 (the upper wall 130). Accordingly, in a state illustrated in FIG. 5, the movable member 91 is at the first position and the detection portion 89 is at the third position.

As described above, the first detection portion 93 at the third position blocks light emitted in the leftward direction 56 from the optical sensor 121. Further, the second detection portion 94 at the third position blocks light emitted in the leftward direction 56 from the optical sensor 123.

Figure 9:
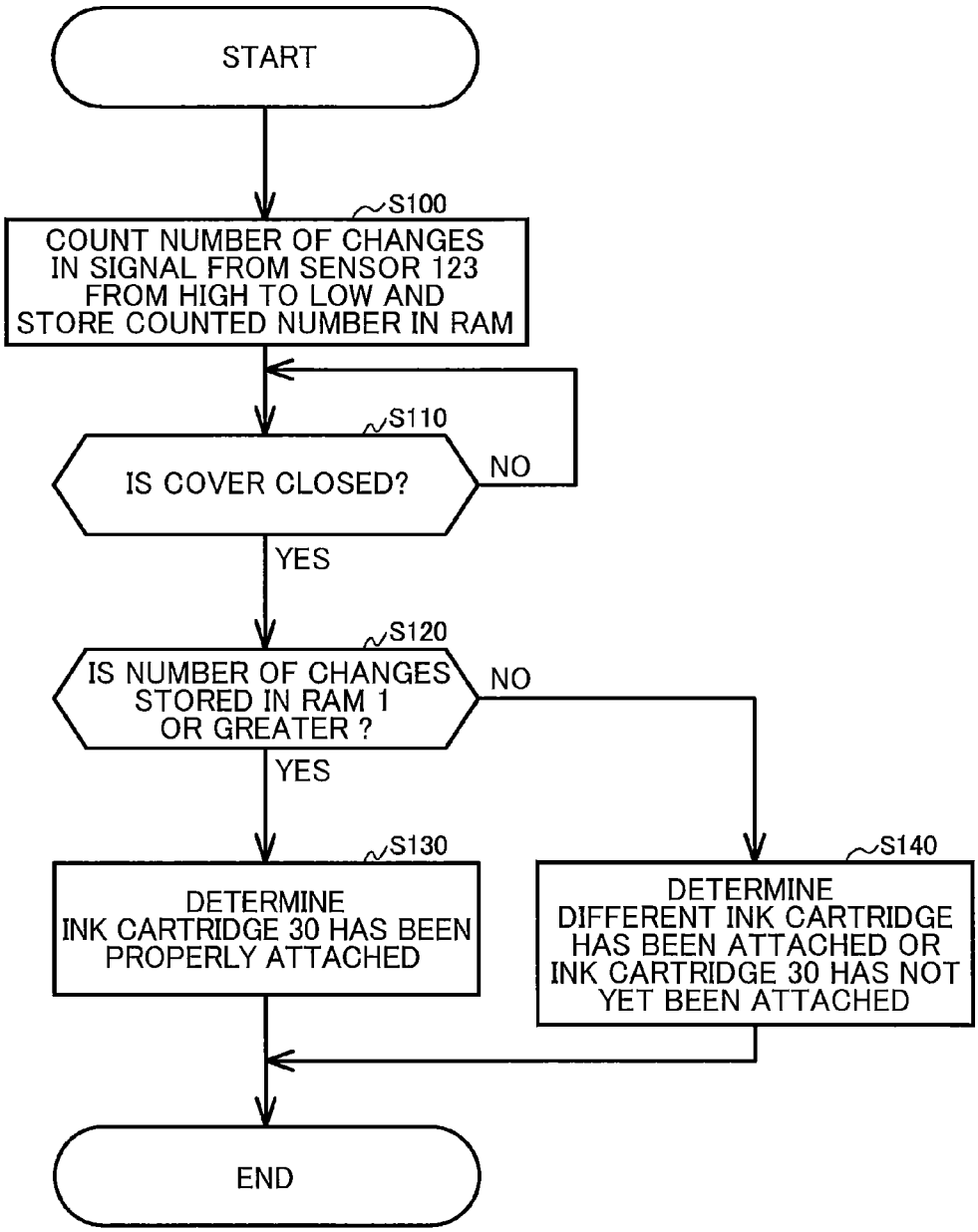
FIG. 9 is a flowchart for explaining a process executed by a controller 1 for determining whether the ink cartridge 30 has been attached to the cartridge attachment section 110.

Next, a process executed by the controller 1 for determining whether the ink cartridge 30 has been attached to the cartridge attachment section 110 will be described with reference to a flowchart in FIG. 9.

The controller 1 counts the number of times of changes in the signal transmitted from the optical sensor 123 to the controller from a high level signal to a low level signal after the cover of the cartridge attachment section 110 is opened and until the cover of the cartridge attachment section 110 is closed, and stores the counted number in the RAM (S100).

Then, the controller 1 determines whether the cover is closed (S110). If the controller 1 determines that the cover is not closed (No in S110), the controller 1 repeats the process in S110. If the controller 1 determines that the cover is closed (Yes in S110), the controller 1 refers to the number of changes stored in the RAM (S120). Then, if the number of changes is 1 or greater (Yes in S120), the controller 1 determines that the ink cartridge 30 has been properly attached to the cartridge attachment section 110 (S130). If the number of changes is zero (No in S120), the controller 1 determines that an ink cartridge different from the ink cartridge 30 has been attached to the cartridge attachment section 110 or the ink cartridge 30 has not been attached to the cartridge attachment section 110 (S140).

Next, how a remaining amount of ink in the ink chamber 36 is detected with the use of the optical sensor 121 will be described.

In a state where a sufficient amount of ink remains in the ink chamber 36, the first detection portion 93 is positioned between the light emitting part of the optical sensor 121 and the light receiving part of the optical sensor 121 as illustrated in FIG. 5. Hence, the optical sensor 121 transmits a low level signal to the controller 1 as indicated by an arrow "A" in FIG. 8C.

When ink stored in the ink chamber 36 is consumed and the amount of ink stored in the ink chamber 36 is reduced in a state illustrated in FIG. 5, the internal pressure of the ink chamber 36 is reduced. In accordance with the reduction in the internal pressure of the ink chamber 36, the bulging portion 60 is elastically deformed so as to deflate in the downward direction 53. As a result, the bulging portion 60 is retracted in the downward direction 53 from the upper surface 130A of the upper wall 130. In accordance with the deformation (i.e. deflation) of the bulging portion 60, the movable member 91 is moved in the rearward direction 52 by the urging force of the coil spring 88 (see FIG. 6). Alternatively, in accordance with the reduction in the internal pressure of the ink chamber 36, the urging force of the coil spring 88 becomes greater than a force to cause the bulging portion to inflate (i.e. distend), and the movable member 91 starts moving in the rearward direction 52 such that a lower surface of the movable member 91 compresses the bulging portion 60. That is, the movable member 91 moves from the first position to the second position. Accordingly, the detection portion 89 moves from the third position to the fourth position.

When the detection portion 89 is at the fourth position, the first detection portion 93 is not positioned between the light emitting part of the optical sensor 121 and the light receiving part of the optical sensor 121 as illustrated in FIG. 6. Accordingly, light emitted from the light emitting part of the optical sensor 121 reaches the light receiving part of the optical sensor 121 without being blocked by the first detection portion 93. Hence, the signal transmitted from the optical sensor 121 to the controller 1 changes from a low level signal to a high level signal as indicated by an arrow "B" in FIG. 8C. As a result, the controller 1 detects that a small amount of ink remains in the ink chamber 36.

Further, when the detection portion 89 is at the fourth position, the second detection portion 94 is positioned between the light emitting part of the optical sensor 123 and the light receiving part of the optical sensor 123 as illustrated in FIG. 6. Accordingly, even though the second detection portion 94 moves from the third position to the fourth position, the second detection portion 94 continues to block light emitted from the light emitting part of the optical sensor 123. Hence, regardless of the movement of the movable member 91 from the first position to the second position, the signal transmitted from the optical sensor 123 to the controller 1 remains unchanged, that is, the optical sensor 123 keeps transmitting a low level signal to the controller 1. As a result, the controller 1 detects that the ink cartridge 30 has still been attached to the cartridge attachment section 110.

<Operational Advantages>

According to the above-described embodiment, the movable member 91 is in contact with the deformable member 58, while being urged by the coil spring 88. While bulging, the bulging portion 60 of the deformable member 58 restricts the movement of the movable member 91 caused by the urging force of the coil spring 88. When elastically deformed due to deflation, the bulging portion 60 no longer restricts the movement of the movable member 91. Hence, the movable member 91 is moved by the urging force of the coil spring 88. As described above, the urging force of the coil spring 88, not a gravitational force acting on the movable member 91, causes the movable member 91 to contact the bulging portion 60. Thus, the movable member 91 and the deformable member 58 do not have to be disposed on the front wall 128 of the ink cartridge 30. That is, a degree of freedom in layout of the movable member 91 and the deformable member 58 can be enhanced.

Further, according to the above-described embodiment, the detection portion 89 includes the first detection portion 93 and the second detection portion 94. Hence, the first detection portion 93 and the second detection portion 94 can be used as light blocking portions that block light emitted from the optical sensors 121 and 123, respectively. Accordingly, two types of detection can be performed by the single movable member 91.

Further, according to the above-described embodiment, the coil spring 88 is positioned further in the rearward direction 52 (i.e. rearward) relative to the movable member 91. Hence, other components, such as a substrate, can be disposed in the ink cartridge 30 at a position forward of the movable member 91.

Further, according to the above-described embodiment, the right wall 126 is made of a resin. That is, most of surfaces defining the ink chamber 36 are made of a resin. In other words, most of walls defining the ink chamber 36 are made of a material that is less likely deformed. Hence, when the internal pressure of the ink chamber 36 is reduced, the deformable member 58 is elastically deformed easily.

Further, according to the above-described embodiment, the ink cartridge 30 includes the guide portion 80. The guide portion 80 can prevent the movable member 91 that is movable in the forward direction 51 and the rearward direction 52 from displacing in the directions other than the forward direction 51 and the rearward direction 52, that is, the upward direction 54, the rightward direction 55, and the leftward direction 56.

Further, according to the above-described embodiment, the movable member 91 is disposed so as to overlap the deformable member 58 in a plan view. Hence, the ink cartridge 30 can be made more compact in the forward direction 51 and the rearward direction 52.

Further, according to the above-described embodiment, a difference in the internal pressure of the ink chamber 36, that is, whether or not the remaining amount of ink stored in the ink chamber 36 is small, can be detected based on a difference in the position of the first detection portion 93.

Further, according to the above-described embodiment, the second detection portion 94 continues to block light emitted from the light emitting part of the optical sensor 123 regardless of the movement of the movable member 91 in the rearward direction 52. This configuration can prevent false detection such that the controller 1 detects that the ink cartridge 30 has been removed even though the ink cartridge 30 has not been removed from the cartridge attachment section 110.

<First Modification>

Figure 10:
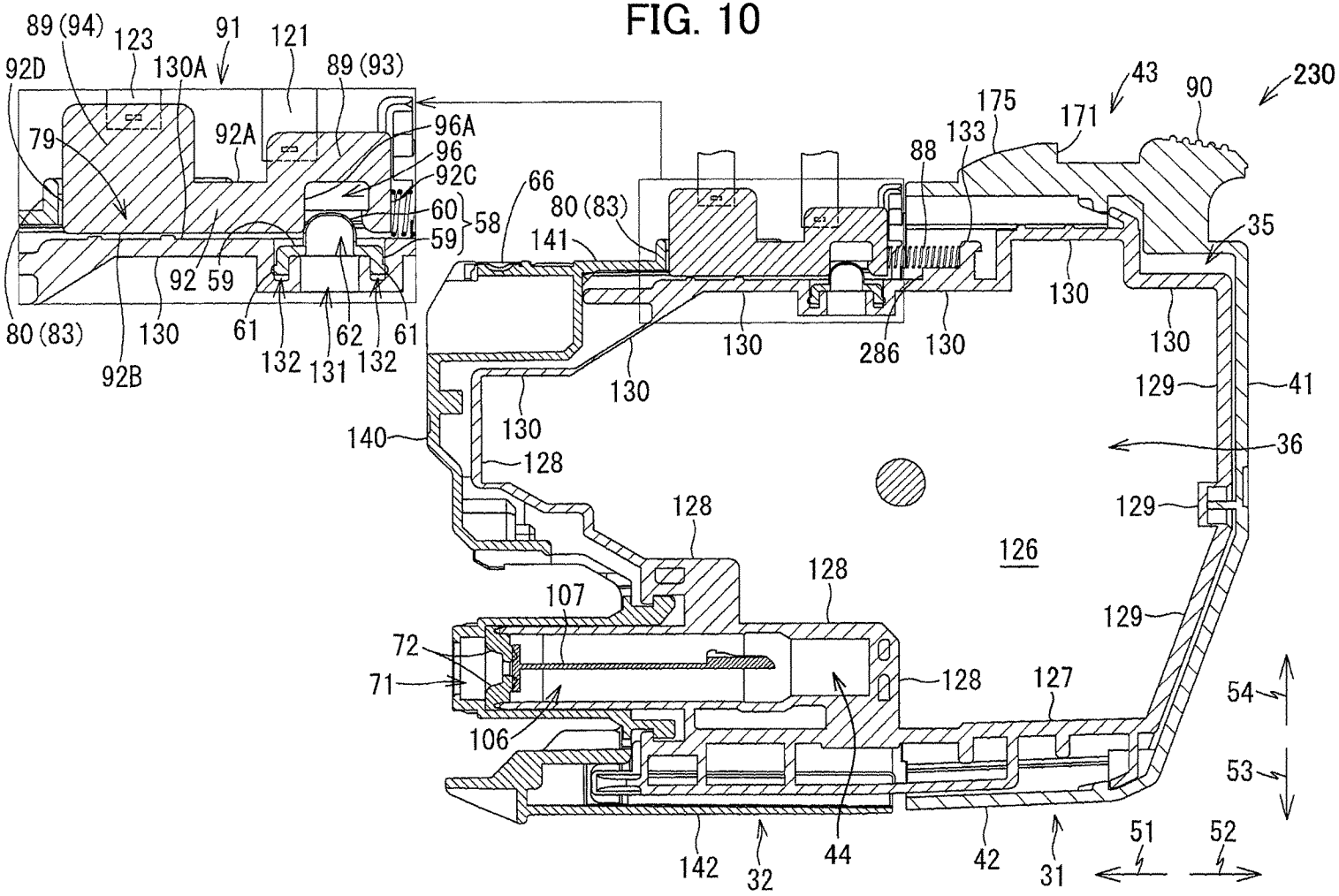
FIG. 10 is a vertical cross-sectional view of an ink cartridge 230 according to a first modification to the embodiment in which a stopper 286 is provided.

Next, an ink cartridge 230 as a liquid cartridge according to a first modification to the embodiment will be described with reference to FIG. 10, wherein like parts and components are designated by the same reference numerals as those of the above-described embodiment to avoid duplicating description.

In the above-described embodiment, the movable member 91 stops at the second position as the coil spring 88 returns to its natural length from the length longer than the natural length. That is, the stoppage of the movable member 91 at the second position relies on the coil spring 88. However, the ink cartridge 230 include a stopper 286 (see FIG. 10) that stops the movable member 91 at the second position and restricts the movable member 91 from moving in the rearward direction 52 further rearward than the second position. For example, the stopper 286 is a stepped surface formed on the upper surface 130A of the upper wall 130 as illustrated in FIG. 10. The stopper 286 contacts, from a downstream side of the movable member 91 in the rearward direction 52, the rear surface 92C of the main body 92 of the movable member 91 that moves in the rearward direction 52 from the first position where the movable member 91 is urged by the coil spring 88. Hence, the stopper 286 restricts the movement of the movable member 91 in the rearward direction 52. The movable member 91 is at the second position when the rear surface 92C is in contact with the stopper 286.

According to a configuration including the stopper 286, the movable member 91 at the first position contacts the deformable member 58, and the movable member 91 at the second position contacts the stopper 286. This configuration can prevent unintentional movement of the movable member 91 at the first position toward positions other than the first position as well as unintentional movement of the movable member 91 at the second position toward positions other than the second position.

<Second Modification>

Next, an ink cartridge 330 as a liquid cartridge according to a second modification to the embodiment will be described with reference to FIGS. 11A through 11D, wherein like parts and components are designated by the same reference numerals as those of the above-described embodiment to avoid duplicating description.

The ink cartridge 330 has a structure that can ensure an easy and reliable reduction in an internal pressure of an ink chamber 336 when an amount of ink stored in the ink chamber 336 is being reduced.

As illustrated in FIGS. 11A through 11D, the ink cartridge 330 includes the ink chamber 336, an ink channel 344 (an example of a liquid channel) and a differential-pressure regulating valve 357. The ink chamber 336 and the ink channel 344 are defined by an inner frame 335.

The ink channel 344 is formed in a front portion of the ink cartridge 330. The ink chamber 336 is formed in a rear portion of the ink cartridge 330.

The ink channel 344 includes a first channel 351 and a second channel 352. The first channel 351 is in communication with the ink supply portion 34. The second channel 352 is formed at a position further in the rearward direction 52 (i.e. rearward) relative to the first channel 351. The second channel 352 is in communication with the first channel 351 through an opening 354, and in communication with a first ink chamber 336A of the ink chamber 336 through an opening 355 (an example of a second opening) and a passage 362. The opening 355 is opened and closed by a spherical body 356 (an example of a second spherical body) that can move in the upward direction 54 and the downward direction 53.

The ink chamber 336 includes the first ink chamber 336A and a second ink chamber 336B. The second ink chamber 336B is formed at a position further in the rearward direction 52 (i.e. rearward) relative to the second channel 352. The second ink chamber 336B is in communication with the first channel 351 through an opening 358 (an example of a first opening) and a passage 360, and in communication with the first ink chamber 336A through a passage 353. The opening 358 is opened and closed by a spherical body 359 (an example of a first spherical body) that can move in the upward direction 54 and the downward direction 53.

The differential-pressure regulating valve 357 is provided between the ink chamber 336 and the ink channel 344. The differential-pressure regulating valve 357 allows the ink chamber 336 and the ink channel 344 to communicate with each other based on a difference between pressure inside the ink chamber 336 and pressure inside the ink channel 344.

The differential-pressure regulating valve 357 includes the above-described two spherical bodies 356 and 359. The spherical body 356 is disposed in the second channel 352. The spherical body 356 has a specific gravity that is greater than that of ink. Thus, when the second channel 352 is filled with ink, the spherical body 356 moves (i.e. sinks) in the downward direction 53 to close the opening 355. The spherical body 359 is disposed in the second ink chamber 336B. The spherical body 359 has a specific gravity that is smaller than that of ink. Thus, when the second ink chamber 336B is filled with ink, the spherical body 356 moves (i.e. floats) in the upward direction 54 by a buoyancy force exerted by ink, opening the opening 358.

The deformable member 58 and the movable member 91 are provided at an upper end portion of the first channel 351. That is, the deformable member 58 is in communication with the ink chamber 336 through the ink channel 344. The deformable member 58 and the movable member 91 have the same configurations as those of the above-described embodiment, and thus, descriptions thereof will be omitted.

Next, an operation of the differential-pressure regulating valve 357 according to this modification will be described.

Figure 11A:
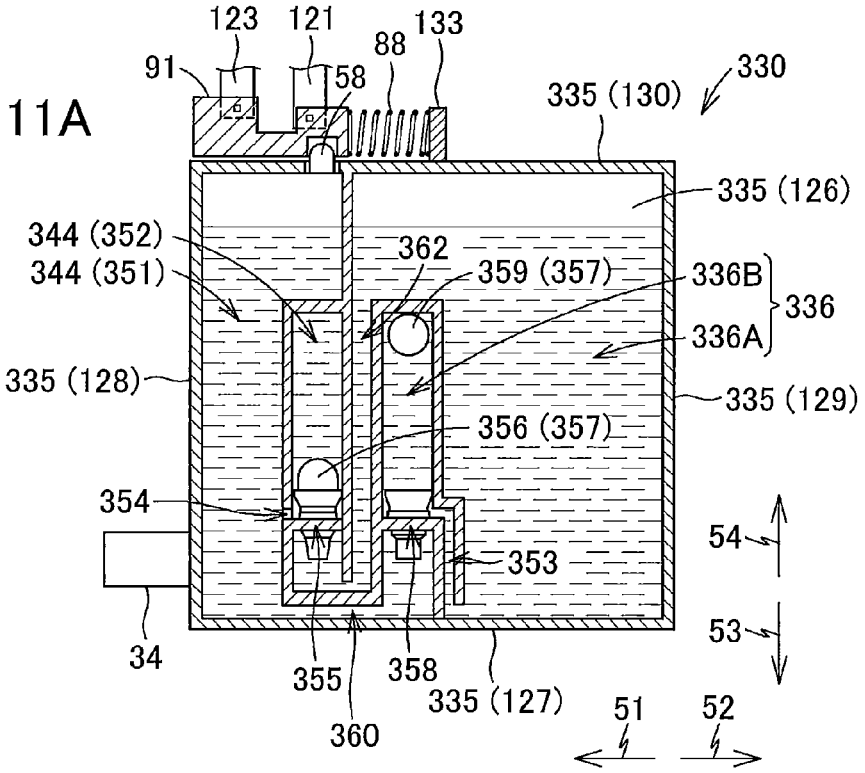

When the ink chamber 336 and the ink channel 344 are filled with ink as illustrated in FIG. 11A, the spherical body 356 sinks to close the opening 355, and the spherical body 359 floats to open the opening 358. Accordingly, when supplying ink from the ink cartridge 330 to the corresponding ink tube 20, ink in the first ink chamber 336A is supplied to the ink tube 20 through the second ink chamber 336B, the first channel 351, and the ink supply portion 34.

Figure 11B:
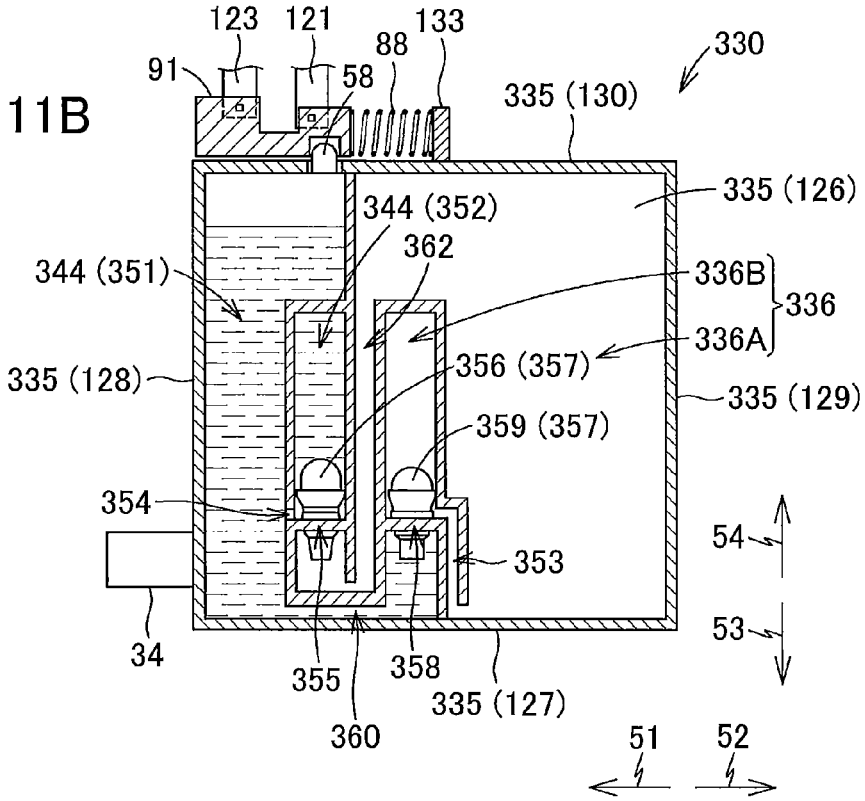

When ink in the ink chamber 336 is reduced to a level illustrated in FIG. 11B, the buoyancy force exerted by ink no longer applies to the spherical body 359. Thus, the spherical body 359 moves in the downward direction 53 to close the opening 358. As a result, communication between the ink channel 344 and the ink chamber 336 is interrupted. Accordingly, ink in the ink channel 344 is supplied to the ink tube 20 through the ink supply portion 34 for supplying ink from the ink cartridge 330 to the ink tube 20.

Figure 11C:
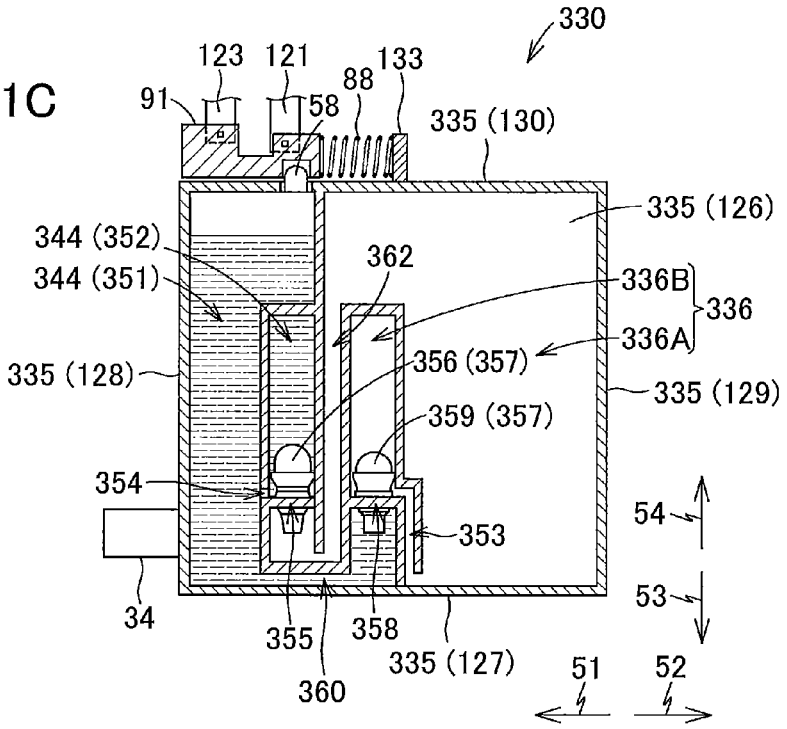

When the amount of ink in the ink channel 344 is reduced, a negative pressure is generated in the ink channel 344 (see FIG. 11C). In FIG. 11C, generation of the negative pressure is illustrated by an increase in density of broken lines in the ink channel 344.

Figure 11D:
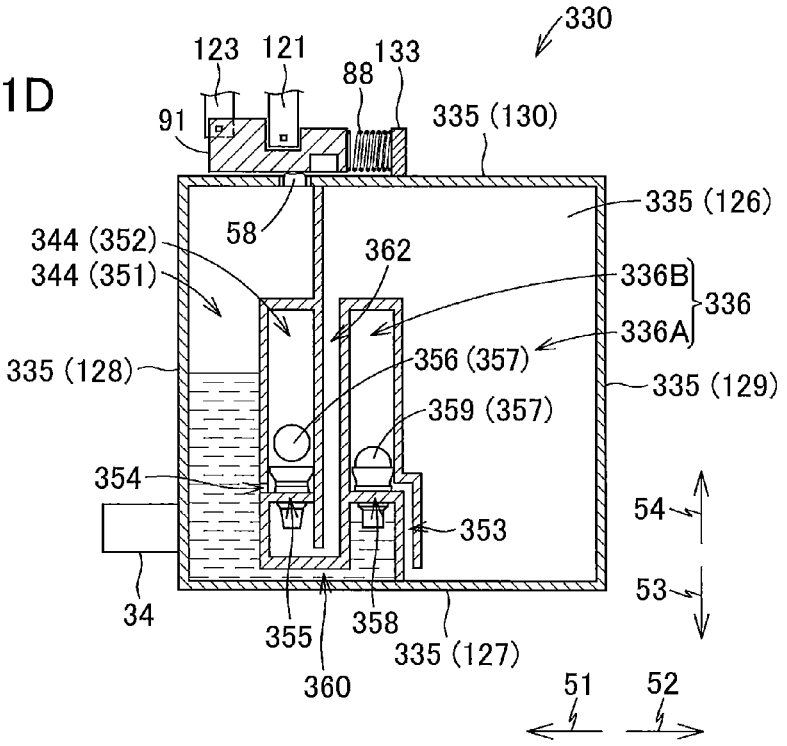

As the negative pressure in the ink channel 344 becomes smaller than the pressure inside the ink chamber 336 by a predetermined value or greater, the spherical body 356 moves in the upward direction 54 due to the negative pressure in the ink channel 344, as illustrated in FIG. 11D. In other words, the spherical body 356 opens the opening 355 when the pressure inside the ink channel 344 is smaller than the pressure inside the ink chamber 336 by the predetermined value or greater. The predetermined value is set to a value that is appropriate to allow ink in the ink channel 344 to reliably and efficiently flow outside thereof by adjusting a material and size of the spherical body 356 or a size of the opening 355.

Further, as the negative pressure in the ink channel 344 becomes smaller than the pressure inside the ink chamber 336 by the predetermined value or greater, the bulging portion 60 of the deformable member 58 is elastically deformed so as to deflate in the downward direction 53. As a result, the bulging portion 60 is retracted in the downward direction 53 relative to the upper surface of the upper wall 130. The movable member 91 is therefore moved in the rearward direction 52 due to the urging force of the coil spring 88. Accordingly, the controller 1 can detect that the amount of ink remaining in the ink chamber 336 and the ink channel 344 becomes small.

When the opening 355 is opened, the first ink chamber 336A and the second channel 352 are brought into communication with each other. As a result, the pressure inside the ink channel 344 returns from the negative pressure to a level equivalent to an atmospheric pressure (i.e. the pressure inside the ink chamber 336). Thus, the spherical body 356 closes the opening 355 again.

Thereafter, ink in the ink channel 344 is consumed while repeating opening and closing of the opening 355.

According to the above-described second modification, when a large amount of ink remains in the ink chamber 336, the spherical body 359 is made to float by the buoyancy force, so that the opening 358 is opened. Accordingly, ink stored in the ink chamber 336 flows into the ink channel 344 through the opening 358 and flows out of the ink supply portion 34. Further, since the opening 358 is opened, the pressure inside the ink chamber 336 is equal to the pressure inside the ink channel 344. Thus, the opening 355 is closed.

When the amount of ink remaining in the ink chamber 336 has been reduced, the spherical body 359 can no longer keep afloat, and closes the opening 358. Thus, communication between the ink channel 344 and the ink chamber 336 is interrupted. This allows ink in the ink channel 344 to flow outside of the ink cartridge 330 through the ink supply portion 34. As a result, the negative pressure in the ink channel 344 becomes greater. In other words, the pressure inside the ink channel 344 becomes smaller. The opening 355 is thereby opened, and the pressure inside the ink channel 344 increases to a level the same as the pressure inside the ink chamber 336. When the pressure inside the ink channel 344 becomes the same level as the pressure inside the ink chamber 336, the opening 355 is closed. Thereafter, opening of the opening 355 due to reduction in the pressure inside the ink channel 344 caused by the outflow of ink in the ink channel 344 and closing of the opening 355 due to an increase in the pressure inside the ink channel 344 caused by the opening of the opening 355 are repeated.

In the second modification, the deformable member 58 communicates with the ink chamber 336 through the ink channel 344. Accordingly, the deformable member 58 can be elastically deformed by the change in pressure inside the ink channel 344.

<Other Modifications>

In the above-described embodiment, the coil spring 88 is disposed further in the rearward direction 52 (i.e. rearward) relative to the movable member 91. However, the coil spring 88 may be disposed further in the forward direction 51 (i.e. forward) relative to the movable member 91 as long as the coil spring 88 urges the movable member 91 toward the deformable member 58. In this case, the coil spring 88 may have a length shorter than the natural length thereof when the movable member 91 is at the first position. That is, the coil spring 88 in this case may be a compression coil spring.

In the above-described embodiment, the front surface 96A defining the recess 96 contacts the bulging portion 60 from a downstream side thereof in the forward direction 51. That is, the movable member 91 contacts the deformable member 58 from a downstream side thereof in the forward direction 51. However, the movable member 91 may contact the deformable member 58 from a downstream side thereof in the rearward direction 52. In this case, the coil spring 88 may urge the movable member 91 in the forward direction 51.

In the above-described embodiment, the deformable member 58 is attached to the upper wall 130, and the bulging portion 60 of the deformable member 58 bulges in the upward direction 54 from the upper surface 130A of the upper wall 130. However, the bulging direction of the bulging portion 60 is not limited to the upward direction 54. For example, the deformable member 58 may be attached to the right wall 126. In this case, the bulging portion 60 may bulge in the rightward direction 55 from the right wall 126. Incidentally, in this case, the movable member 91 may be disposed at a right side of the right wall 126 in the rightward direction 55.

In the above-described embodiment, the detection portion 89 includes the first detection portion 93 and the second detection portion 94. However, the detection portion 89 may include only one of the first detection portion 93 and the second detection portion 94, or may include third and subsequent detection portions in addition to the first detection portion 93 and the second detection portion 94. For example, in FIG. 3, the second detection portion 94 may be a plate-like detection portion that extends from the upper surface 141 of the front cover 32 of the ink cartridge 30, and the first detection portion 93 may be movable relative to the second detection portion 94 in the forward direction 51 and the rearward direction 52.

Further, a space through which light is transmissive in the rightward direction 55 and the leftward direction 56 may not be formed between the first detection portion 93 and the second detection portion 94, and the first detection portion 93 and the second detection portion 94 may be a single continuous portion. In this case, for example, the bulging portion 60 may restrict the detection portion 89 urged in the forward direction 51 from moving in the forward direction 51, and the detection portion 89 may move in the forward direction 51 in accordance with the deformation of the bulging portion 60. In this case, the light receiving part of the optical sensor 121 may receive light emitted from the light emitting part of the optical sensor 121 when the detection portion 89 is moved to the second position in accordance with the deformation of the bulging portion 60.

In the above-described embodiment, the movable member 91 is disposed such that at least a part of the movable member 91 overlaps the deformable member 58 in a plan view. However, the movable member 91 may not overlap the deformable member 58 in a plan view. For example, the movable member 91 may be positioned further in the forward direction 51 (i.e. forward) relative to the bulging portion 60 of the deformable member 58, and the rear surface 92C of the main body 92 may contact the bulging portion 60 from a downstream side thereof in the forward direction 51.

In the above-described embodiment, the detection portion 89 (the first detection portion 93 and the second detection portion 94) is positioned between the light emitting part and the light receiving part of the optical sensor, and blocks light emitted from the light emitting part. However, the detection portion 89 may attenuate light emitted from the light emitting part, not blocking light emitted from the light emitting part. Specifically, illumination intensity of light received by the light receiving part when the detection portion 89 is positioned between the light emitting part and the light receiving part may only have to be smaller than illumination intensity of light received by the light receiving part when the detection portion 89 is not positioned between the light emitting part and the light receiving part.

Ink has been described as an example of liquid in the above-described embodiment. However, liquid is not limited to ink. For example, instead of ink, pretreatment liquid that is ejected to a sheet prior to ink during printing may be used as liquid.

While the description has been made in detail with reference to the embodiment thereof, it would be apparent to those skilled in the art that various changes and modifications may be made therein without departing from the scope of the disclosure.

What is claimed is:

1. A liquid cartridge comprising:

a casing including a front wall and a liquid chamber configured to store liquid therein, the liquid chamber being configured such that an internal pressure of the liquid chamber is reduced in accordance with outflow of liquid from the liquid chamber;

a liquid supply portion disposed at the front wall and configured to allow liquid in the liquid chamber to flow out of the liquid chamber;

a deformable member protruding from the casing in a cross direction that crosses a forward direction and a rearward direction and having an internal space that is in communication with the liquid chamber, the deformable member having such an elasticity that a dimension of the deformable member in the cross direction becomes smaller in accordance with the reduction in the internal pressure of the liquid chamber;

a movable member including a detection portion configured to be detected from an exterior of the liquid cartridge and a contact portion configured to contact the deformable member, the movable member being supported to the casing and movable in the forward direction and the rearward direction relative to the casing, the contact portion being in contact with the deformable member and disposed at one of a position further forward relative to the deformable member and a position further rearward relative to the deformable member; and an urging member configured to urge the movable member to move the contact portion toward the deformable member.

2. The liquid cartridge according to claim 1, wherein the casing includes an upper surface, wherein the deformable member protrudes in an upward direction from the upper surface of the casing and is elastically deformable in a downward direction in accordance with the reduction in the internal pressure of the liquid chamber, and wherein the movable member is supported to the upper surface of the casing.

3. The liquid cartridge according to claim 1, wherein the detection portion comprises:

a first detection portion protruding from the casing in a direction away from the casing; and a second detection portion protruding from the casing in a direction away from the casing and being spaced apart from the first detection portion in one of the forward direction and the rearward direction.

4. The liquid cartridge according to claim 1, wherein the urging member is positioned rearward of the movable member.

5. The liquid cartridge according to claim 1, wherein the casing has a right wall defining a right end of the liquid chamber and a left wall defining a left end of the liquid chamber, at least one of the right wall and the left wall being made of a resin.

6. The liquid cartridge according to claim 1, wherein the casing including a liquid channel connecting the liquid chamber to the liquid supply portion, the casing having a first opening and a second opening through which the liquid chamber communicates with the liquid channel; and the liquid cartridge further comprising: a differential-pressure regulating valve configured to provide communication between the liquid chamber and the liquid channel based on a difference between the internal pressure of the liquid chamber and an internal pressure of the liquid channel, wherein the differential-pressure regulating valve comprises:

a first spherical body disposed in the liquid chamber and configured to open the first opening by a buoyancy force exerted by liquid stored in the liquid chamber; and a second spherical body disposed in the liquid channel and configured to open the second opening as the internal pressure of the liquid channel becomes smaller than the internal pressure of the liquid chamber by a predetermined value or greater, and wherein the deformable member is configured to communicate with the liquid chamber through the liquid channel.

7. The liquid cartridge according to claim 1, further comprising a locking portion configured to engage with a cartridge attachment section to which the liquid cartridge is detachably attachable, wherein the urging member is positioned downward of the locking portion.

8. The liquid cartridge according to claim 1, further comprising a guide configured to restrict movement of the movable member in an upward direction, a rightward direction, and a leftward direction.

9. The liquid cartridge according to claim 1, wherein the urging member is configured to urge the movable member in an urging direction such that the contact portion moves toward the deformable member, wherein the movable member is configured to move to a first position where the contact portion is in contact with the deformable member and to a second position positioned further in the urging direction relative to the first position, and wherein the casing further includes a stopper configured to contact the movable member at the second position to restrict the movable member at the second position from moving in the urging direction.

10. The liquid cartridge according to claim 1, wherein the casing further includes:

a rear wall spaced apart from the front wall in the rearward direction, the liquid chamber being disposed between the front wall and the rear wall; and an upper wall disposed between the front wall and the rear wall, and wherein the detection portion protrudes in the upward direction from the upper wall.

11. The liquid cartridge according to claim 10, wherein the urging member is configured to urge the movable member in the rearward direction to move the contact portion toward the deformable member, and wherein the movable member is configured to move to a first position where the contact portion is in contact with the deformable member and to a second position where the movable member is positioned further rearward relative to the movable member at the first position.

12. The liquid cartridge according to claim 10, wherein the movable member is positioned on the upper wall such that at least a portion of the movable member overlaps the deformable member in a plan view.

13. The liquid cartridge according to claim 10, wherein the detection portion is configured to move, in conjunction with the movement of the movable member in the forward direction and the rearward direction relative to the casing, to a third position where the contact portion is in contact with the deformable member and to a fourth position different from the third position, and wherein the detection portion comprises a first detection portion, the detection portion at the third position placing the first detection portion at a position capable of blocking or attenuating light emitted from a first optical sensor and traveling in a direction crossing the forward direction and the upward direction, the first optical sensor being provided in an cartridge attachment section to which the liquid cartridge is detachably attachable, the detection portion at the fourth position placing the first detection portion at a position incapable of blocking or attenuating the light emitted from the first optical sensor.

14. The liquid cartridge according to claim 13, wherein the detection portion further comprises a second detection portion spaced apart from the first detection portion in one of the forward direction and the rearward direction, and wherein the detection portion at the third position and at the fourth position places the second detection portion at a position capable of blocking or attenuating a light emitted from a second optical sensor and travelling in the direction crossing the forward direction and the upward direction, the second optical sensor being provided in the cartridge attachment section.

15. The liquid cartridge according to claim 14, wherein the second detection portion protrudes further upward relative to the first detection portion.

* * * * *